US005388623A

United States Patent [19]

Homma et al.

[11] Patent Number: 5,388,623

[45] Date of Patent: Feb. 14, 1995

[54] ELASTIC WHEELS AND A PAIR OF SKIS PROVIDED WITH THE ELASTIC WHEELS

[75] Inventors: Akira Homma; Susumu Homma; Hiroshi Sato; Hisao Hiroi, all of Tokamachi, Japan

[73] Assignee: Homma Science Corporation, Niigata, Japan

[21] Appl. No.: 983,574

[22] PCT Filed: Jul. 3, 1992

[86] PCT No.: PCT/JP92/00845

§ 371 Date: Feb. 5, 1993

§ 102(e) Date: Feb. 5, 1993

[87] PCT Pub. No.: WO93/11836

PCT Pub. Date: Jun. 24, 1993

[30] Foreign Application Priority Data

Dec. 17, 1991 [JP] Japan ..... 3-333701
Feb. 25, 1992 [JP] Japan ..... 4-37901

[51] Int. Cl.[6] ..... B60C 7/10; B60C 7/22

[52] U.S. Cl. ..... 152/5; 280/842; 152/12; 152/276; 152/301; 301/5.3

[58] Field of Search ..... 152/1, 5, 6, 7, 11, 152/12, 323, 393, 394, 300, 301, 306, 270, 273, 275, 276, 278, 280, 281; 301/1, 5, 63.1, 5.3, 5.7; 280/842, 11.22, 11.23

[56] References Cited

U.S. PATENT DOCUMENTS 1,214,137 1/1917 Clawson ..... 152/301
1,500,137 7/1924 Dade ..... 152/306
1,636,483 7/1927 Nielsen ..... 152/7 X
1,682,899 9/1928 Fletcher ..... 152/7 X
1,887,019 11/1932 Hart ..... 152/276
2,436,844 3/1948 Wells ..... 152/280
2,766,802 10/1956 Gzobowski ..... 152/9 X
3,380,779 4/1968 Albright ..... 152/12 X

FOREIGN PATENT DOCUMENTS 1919396 10/1969 Germany ..... 152/301
55-62378 4/1980 Japan .
63-57302 3/1988 Japan .
63-74170 5/1988 Japan .
3-28002 2/1991 Japan .

*Primary Examiner*—Russell D. Stormer
*Attorney, Agent, or Firm*—Ladas & Parry

[57] ABSTRACT

A pair of roller skis 300 each constituted by attaching elastic wheels 302 to a boot-placing plate 301 in the front thereof and at the back thereof. The elastic wheels 302 each comprises a wheel supporting means having a circular rim part on the outer periphery and a tire part mounted on the circular rim part of the wheel supporting means and being elastically deformable in the direction perpendicular to the running direction of the wheel. Each elastic wheel 302 enables the running direction thereof to be simply changed with the wheel shaft kept in the same direction, and utilization of the features permits a skier to operate the roller skis with a feeling similar to that afforded by conventional snow skis.

20 Claims, 52 Drawing Sheets

ELASTIC WHEELS AND A PAIR OF SKIS PROVIDED WITH THE ELASTIC WHEELS

TECHNICAL FIELD

The present invention relates to elastic wheels each provided with a tire part which can be elastically deformed in a direction perpendicular to that of the running rotation of the wheel during the running thereof and to a pair of skis provided with the elastic wheels.

Various kinds of sporting goods have been hitherto developed for an operator to slide down a slope without snow or slide on the ground without snow, using a technique similar to that of skiing. One of the typical ones is a so-called pair of roller skis each having wheels rotatably attached to the front of and at the back of a mount on which a ski boot is placed or to the bottom surface thereof, and the running function of the rotating wheels is utilized to provide the function of sliding down a slope or sliding on the ground similarly to the function of the ski.

If a skier slides down a slope wearing such roller skis and attempts to operate them with a technique similar to that of the original skis on snow, it is necessary to apply a strong force on the roller wheels in the direction perpendicular to the running direction of the wheels and, at the same time, make them shift (sideslip) in the direction perpendicular to the running direction. However, since the ordinary wheels are rotated about the wheel shaft, the running direction is limited to that perpendicular to the wheel shaft. The shifting of the wheels in the direction perpendicular to that of the running rotation thereof generally damages the running property of the wheels and causes significant damage to the tire parts.

This has brought about the development of a wheel having a tire part made of an elastic material such as a rubber material and provided at the ends of the outer periphery thereof with edges (For example, refer to JP-B-61-59745). This means that the wheel is devised to positively cause a sideslip to easily allow a turning motion and, at the same time, to cause the edges to produce a braking operation to make the turning motion sharper.

However, since the sideskipping motion utilizing such a normal elastic deformation of the tire part can provide neither a sufficient turning ability nor a rapid braking and stopping motion, use of the above-described wheels for skis is difficult.

Further, another pair of roller skis have been developed in which, in order to facilitate a turning motion of the roller skis during the running thereof, each entire roller wheel is elastically supported so that application of a load causes the wheel shaft of the roller wheel to be inclined (For example, refer to JP-B-52-24901 and JP-B-53-22494).

However, such an inclination of the wheel shaft of the roller shaft during the running thereof provides an extraordinarily unstable running motion which causes the rider to easily fall down. Particularly, use of the pair of roller skis as a pair of skis is dangerous for a rider who slides down a slope at a high speed.

DISCLOSURE OF THE INVENTION

The present invention is made in view of the points as described above and aims at providing a pair of roller skis which exhibits a running ability similar to and with a technique similar to those in the case of operating a pair of normal skis used on snow.

The inventors relating to the present application have learned that a pair of roller skis can be turned and stopped similarly to a pair of normal skis by causing the tire part of the roller wheel to produce a transversal shift in the direction perpendicular to the running direction of the wheel shaft. Hereupon, in order to achieve the object as described above, the inventors have developed an elastic wheel which facilitates the shift of the wheel in the direction perpendicular to the running direction thereof and has superior turning and braking functions.

The elastic wheel according to the invention is characterized in that the wheel comprises a wheel supporting means having a circular rim part formed on and around the outer periphery thereof, and a tire part mounted on the circular rim part of the wheel supporting means and being elastically deformable in the direction perpendicular to the running direction of the wheel.

According to a preferable embodiment of the invention, the tire part is composed of a ring-like elastic member of a cross-section having a dimension of transverse width in the outer periphery greater than that in the inner periphery.

In a further preferable embodiment of the invention, the tire part is constituted by a plurality of elastic pieces arranged on and around the periphery thereof.

In a still further preferable embodiment of the invention, the tire part is provided therein with a core disk having a plurality of disk pieces radially arranged.

In another preferable embodiment of the invention, the tire part is constituted by arranging on and around the circular rim of the wheel a plurality of swinging members supported for swinging about a shaft extending in the same direction as the direction tangential to the circular rim part.

The elastic wheel according to the invention runs in the direction of rotation of the wheel shaft and, at the same time, when an external force acts on the wheel in the direction perpendicular to the running direction, the tire parts are continuously displaced in the direction perpendicular to the running direction corresponding to the magnitude of the external force and the wheel shifts (sideslips) in the direction perpendicular to the running direction. Therefore, utilization of such a shift enables the wheel to be suddenly stopped or acutely turned.

A pair of skis according to the invention is constituted by using the elastic wheels as described above and is characterized in that each of the skis comprises a boot-placing plate on which the boot of a skier is placed and fixed and rotating wheels rotatably attached to the boot-placing plate at the front and rear portions thereof, at least one of the rotating wheels consisting of an elastic wheel having a tire part elastically deformable in the direction perpendicular to the running direction of the wheel.

With this pair of skis, a straight running action, a sideslip, and a sudden stop or turning action are combined so that a skier can slide down a slope with a feeling similar to that of ordinary skis on snow, displaying a manipulating performance similar to that of such skis.

BEST MODES FOR CARRYING OUT THE INVENTION

Now, embodiments of the invention will be described with reference to the drawings.

Figure 1:
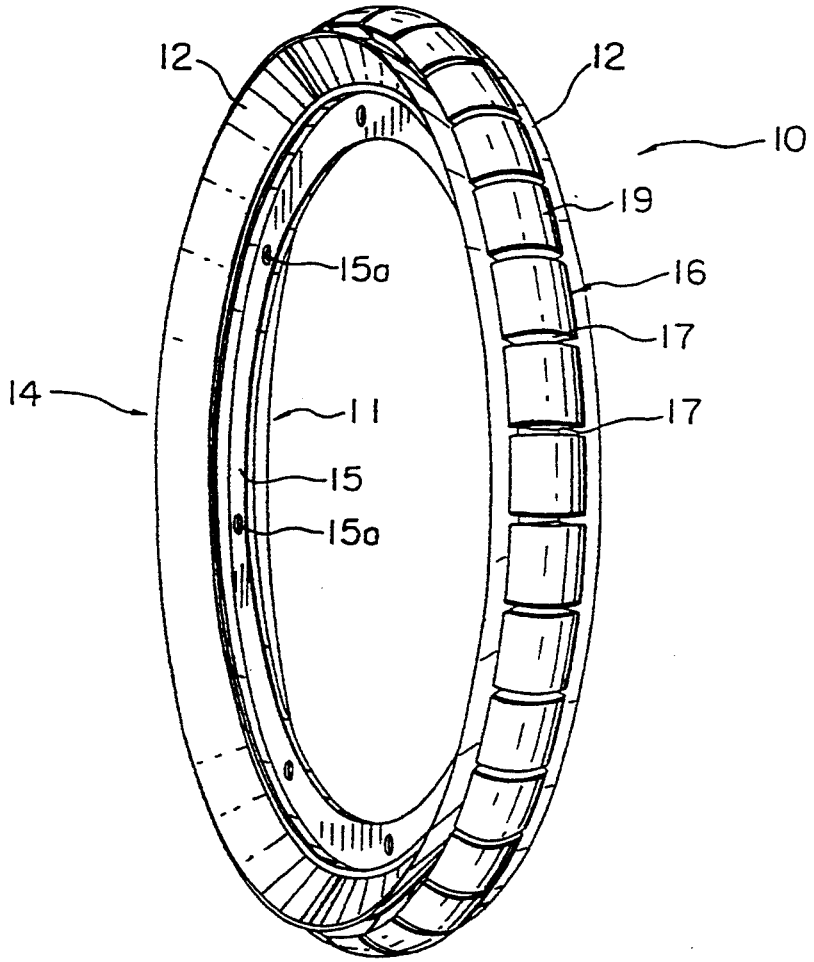
FIG. 1 is a perspective view showing the exterior appearance of a first embodiment of an elastic wheel according to the invention.
Figure 2:
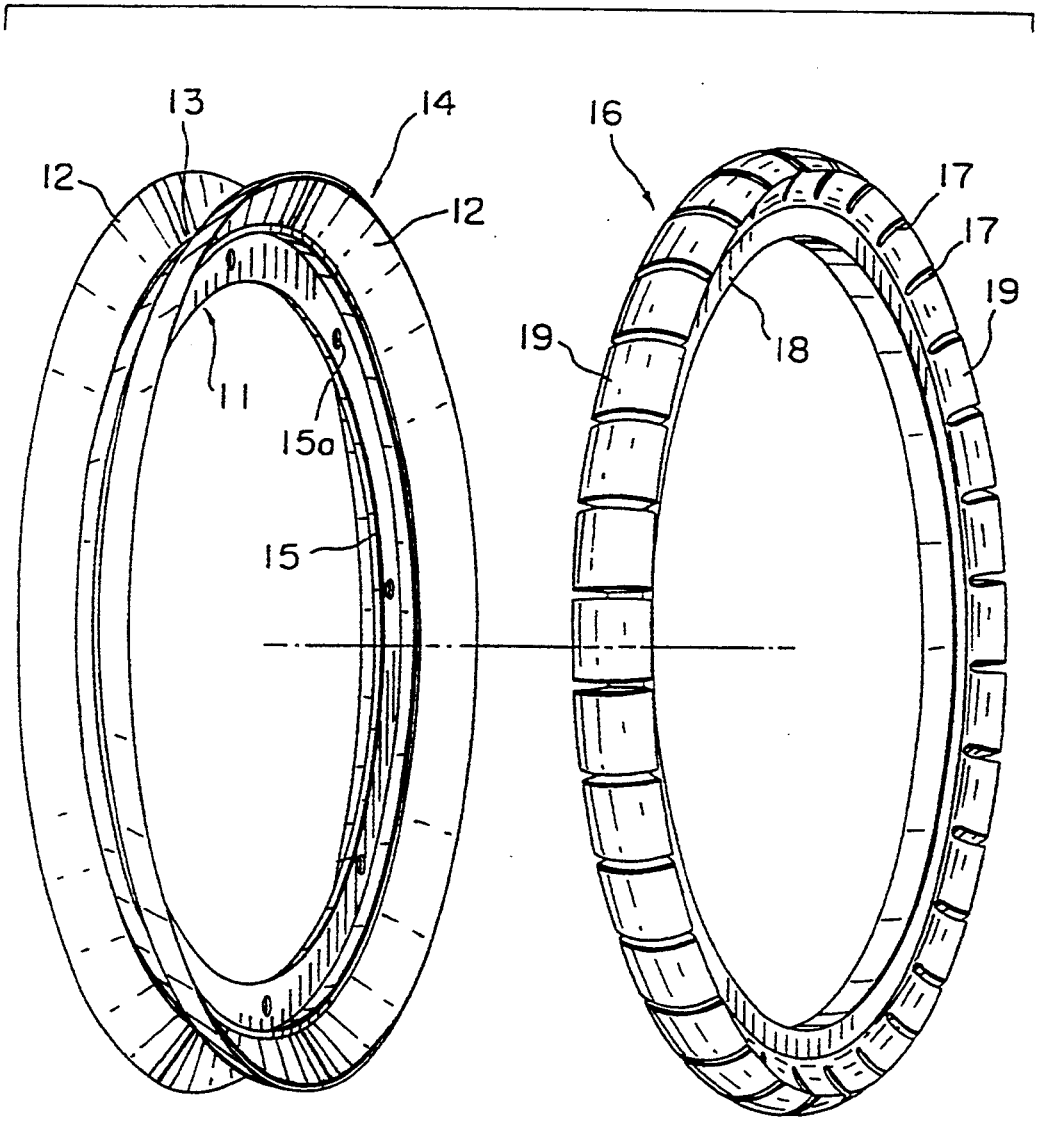
FIG. 2 is an exploded perspective view of the same.
Figure 3:
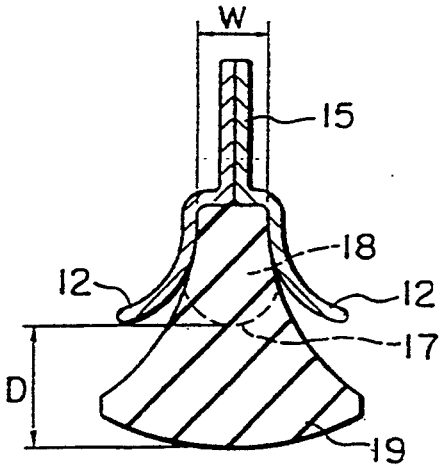
FIG. 3 is a partial sectional view of the elastic wheel.

FIGS. 1 to 3 show an embodiment of an elastic wheel 10 according to the invention. Referring to the drawings, numeral 11 designates a disk for supporting the entire wheel, which has, on the outer periphery thereof, a circular rim part 14 constituted by two rims 12 and having a concave groove 13. A rim flange 15 extending radially inwardly is connected to the inner periphery of the circular rim part 14 and provided with bolt holes 15*a* for fastening it on a wheel disk (not shown).

A tire part 16 formed by an elastic member is mounted on the outer periphery of the circular rim part 14. The tire part 16 is in the form of a ring as shown in FIG. 2 and provided radially with a plurality of slits 17 on the outer periphery thereof at equal pitch intervals. The tire part 16 has, in the inner periphery thereof, a continuous base end portion 18 which maintains the same width all the way around.

The provision of the plurality of slits 17 forms, in the outer periphery of the tire part 16, a plurality of elastic pieces 19 which are each allowed to be elastically deformed independently.

Each of the elastic pieces 19 has a section in which the outer periphery is greater in width than the base end portion 18. Preferably, the depth D of the slit 17 is 0.7 times the minimum dimension of the width at the base end portion.

The mounting of the tire part 16 on the circular rim part 14 is carried out by fitting the base end portion 18 in the groove 13 and disposing the elastic piece 19 so that it extends outwardly from the outer periphery of the circular rim part 14.

The operation of the elastic wheel 10 constituted as described above will be described with reference to FIG. 4.

Figures 4A, 4B, 4C:
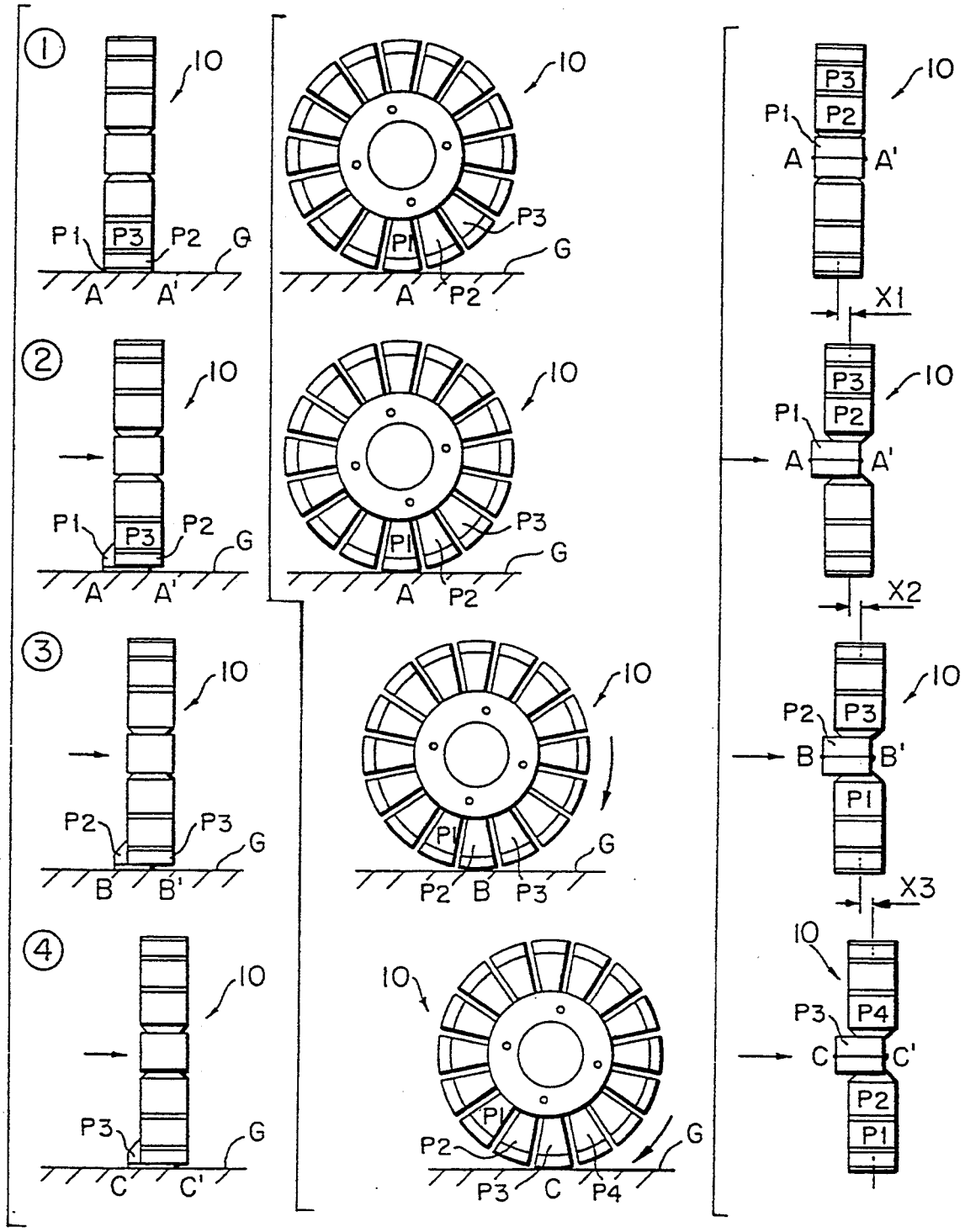
FIGS. 4 (A), (B) and (C) are views for explaining the action of the elastic wheel, (A) being a view as seen from the front of the elastic wheel, (B) being a view as seen from the lateral side, and (C) being a view as seen from the lower side, of the surface of the wheel which is in contact with the ground.

Referring to FIG. 4, (A) shows a view of the elastic wheel 10 as seen from the front, (B) a view as seen from the lateral side, and (C) a view as seen from the lower side of the surface which is in contact with the ground. The elastic wheel 10 is assumed to act on the following preconditions to facilitate the description.

(i) The tire part is an elastic body. However the surface which is in contact with the ground is assumed to be a point contact (line contact).

(ii) The force regarding the transversal shift of the wheel is assumed to be only a thrust load acting on the wheel shaft.

(iii) The wheel is assumed to run from the surface of the drawing to the front in the view (A) as seen from the front, to run from the left to the right in the view (B) as seen from the lateral side and to run from the lower side to the upper side of the surface of the drawing in the view (C) as seen from the lower side of the surface which is in contact with the ground.

(1) shows the state immediately before the start of rotation. The elastic wheel 10 is in contact with the ground G along line A—A'. When a thrust load is applied to the wheel shaft in this state, it is transmitted to the tire part and a first elastic piece P1 is elastically deformed in the direction in which the thrust load is applied while being kept in the state where the first elastic piece is in contact with the ground G along line A—A', so that the elastic wheel 10 is shifted transversely by the amount (X1) of the elastic deformation (the state of (2)).

Then, rotation of the elastic wheel 10 from the state of (2) to the arrow-marked direction causes the ground contact line of the tire part to shift to line B—B' and a second elastic piece P2 to come in contact with the ground G. The second elastic piece P2 is subjected to a thrust load from the time it comes into contact with the ground, to thereby perform an elastic deformation so that the elastic wheel 10 is further shifted transversely (the state of (3)). On the other hand, the first elastic piece P1 released from the state where it is in contact with the ground is restored from the state of deformation to its original position.

Subsequently, further rotation of the elastic wheel 10 from the state of (3) causes the ground contact line of the tire part to shift to line C—C' and the second elastic piece P2 to come into contact with the ground G. A third elastic piece P3 is similarly subjected to a thrust load to be elastically deformed so that the elastic wheel 10 is further shifted transversely by the amount (X3) of the elastic deformation (the state of (4)).

In this way, while the elastic wheel 10 subjected to a thrust load is rolled from the position where the first elastic piece P1 is in contact with the ground to the position where the third elastic piece P3 comes into contact with the ground, the elastic wheel 10 is shifted transversely (the direction perpendicular to the running direction of the wheel 10) by the distance of $X1+X2+X3$, which is the sum of the amounts of the elastic deformations of the elastic pieces P1, P2, P3. Consequently, the elastic wheel 10 runs in rotation in the oblique and front direction with the wheel shaft being kept to run in the same direction.

The amount of transverse shifting of the elastic wheel 10 changes depending on an applied thrust load, that is, when a greater thrust load is applied, the elastic piece undergoes a greater elastic deformation to cause a greater amount of transverse shifting, and when a smaller thrust load is applied, a smaller amount of transverse shifting is caused conversely. Further, a change in the direction of the applied thrust load causes the direction of the transversal shift to be changed from side to side. Besides, control of the magnitude and direction of the applied thrust load enables the elastic wheel 10 to run freely in an arbitrary direction and at an arbitrary turning angle.

The present embodiment thus enables the tire part 16 to positively perform an elastic deformation utilizing a thrust load applied to the elastic wheel 10 and to thereby change arbitrarily the running direction of the wheel without using any particular steering gear or inclining the wheel shaft.

Utilization of the motion of the elastic wheel 10 enables implements provided with the elastic wheels 10, for example, a pair of roller skis to display a feeling of use similar to that of a pair of skis on snow and to provide superior turning and stopping motions.

Figure 5:
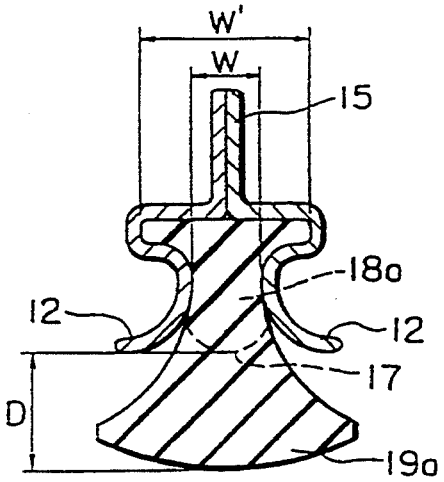
FIG. 5 is a partial sectional view showing a modification of the elastic wheel.
Figure 6:
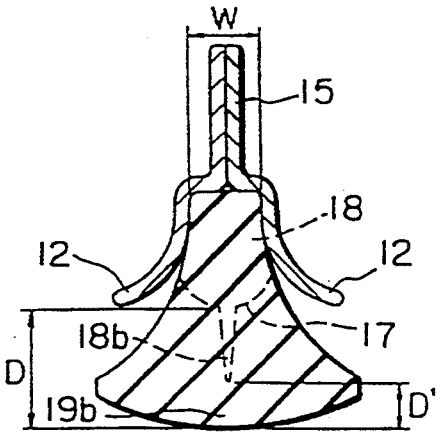
FIG. 6 is a partial sectional view showing another modification of the elastic wheel.

FIGS. 5 and 6 are views corresponding to FIG. 3 showing a modification of the tire part. In the modification shown in FIG. 5, the dimension of width W' at the innermost periphery of the base end portion 18*a* of the tire part is made greater than that of the minimum width W. This provides a greater force to grip the base end portion 18*a* with the rim 12 to ensure more positive mounting of the tire part on the circular rim portion. Also, in this case, the cutting depth D of the slit 17 is determined at a value of 0.7 times the dimension of the minimum width W of the base end portion 18.

In the modification shown in FIG. 6, one respective rib 18*b* for connecting the adjacent elastic pieces 19*b* with each other is provided between the slits 17. This makes it possible to transmit the elastic deformation of one elastic piece 19*b* to the adjacent elastic piece so that each of the elastic pieces can perform smoothly the continuous elastic displacement followed by the rotation of the elastic wheel 10. Also, in this case, the cutting depth D of the slit 17 is preferably 0.7 times the dimension of the minimum width W of the base end portion 18*a*, similar to that of the tire part shown in FIGS. 3 and 5 independently of the rib 18*b*.

Figure 7:
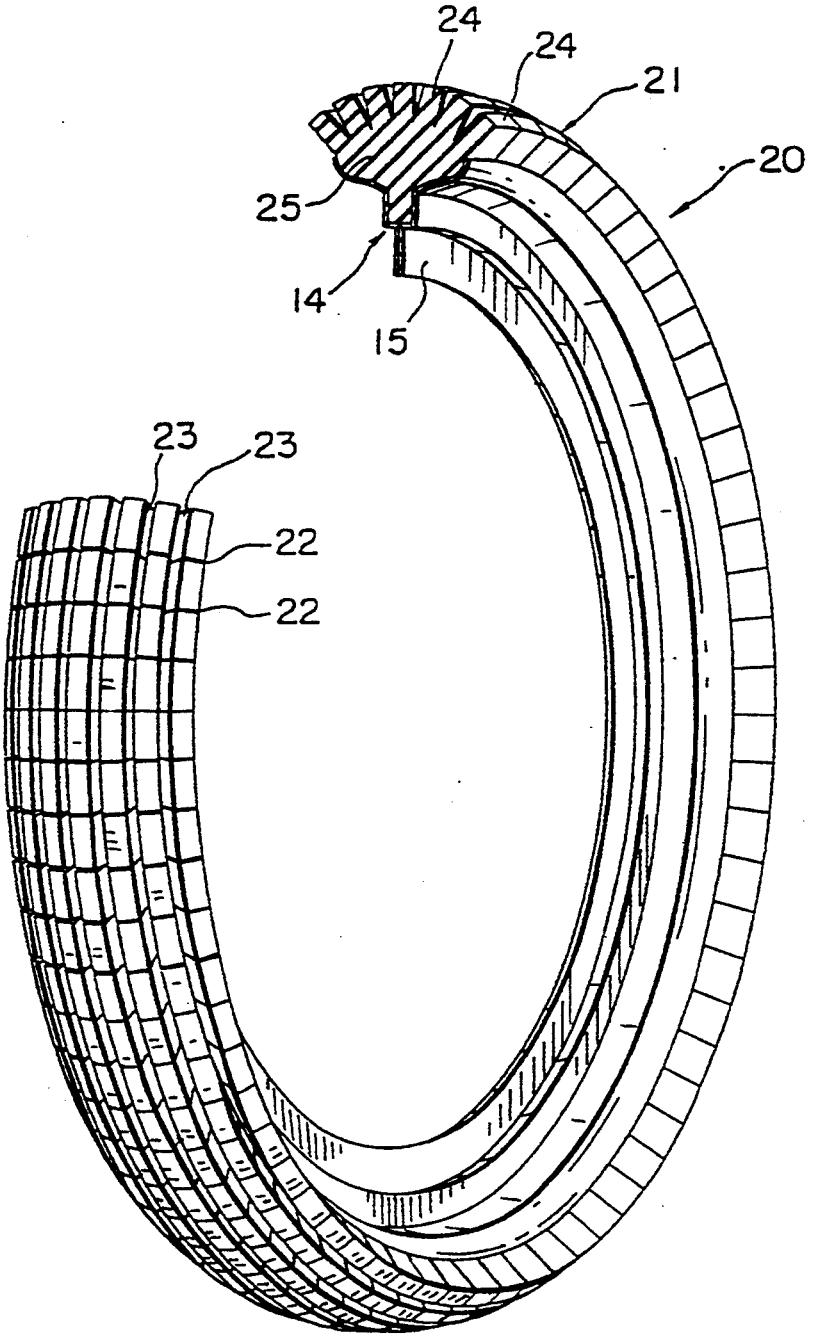
FIG. 7 is a perspective view, partially broken away, showing the exterior appearance of a second embodiment of the elastic wheel according to the invention.

FIG. 7 is a perspective view, partially broken away, showing a second embodiment of an elastic wheel 20 according to the invention.

In the present embodiment, a tire part 21 is provided in the outer periphery thereof with a plurality of radial slits 22 and also in the circumferential direction with a plurality of slits 23.

The provision of the circumferential slits 23 forms a number of elastic pieces 24 in the outer periphery of the tire part 21. The base end portion 25 of the tire part 21 is fitted in and mounted on the circular rim part 14, similarly as in the embodiment described above.

In the present embodiment, the elastic pieces 24, which are finely divided, easily perform the elastic deformation with a relatively smaller external force. For this reason, the elastic wheel according to the present embodiment is suitable for implements used for children light in weight or beginners, both of whom have difficulty in applying a sufficient operational force to the wheel.

Figure 8:
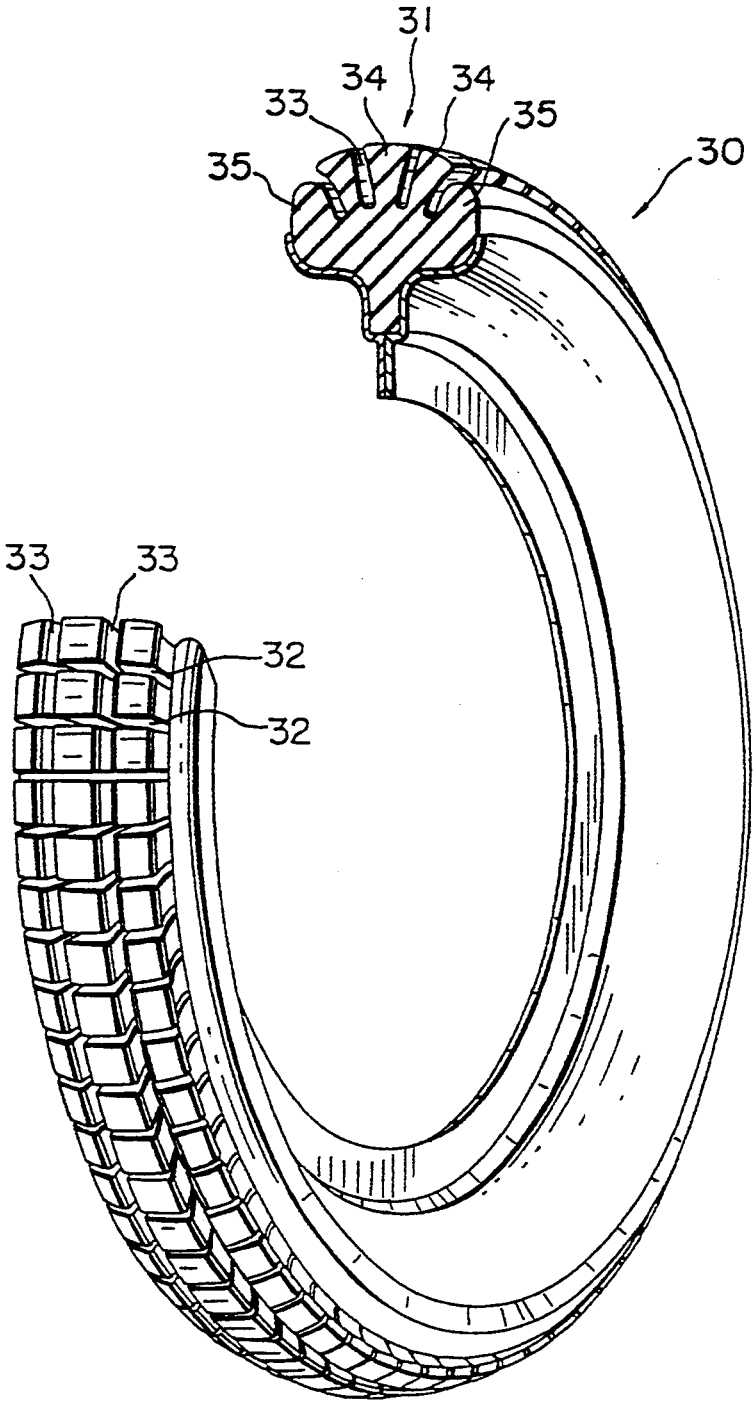
FIG. 8 is a perspective view, partially broken away, showing the exterior appearance of a third embodiment of the elastic wheel according to the invention.

FIG. 8 is a perspective view, partially broken away, showing a third embodiment of an elastic wheel 30 according to the invention.

In the present embodiment, the tire part 31 is provided in the outer periphery thereof with a plurality of radial slits 32 and also in the circumferential direction with a plurality of slits 33, so that a number of elastic pieces 34 are formed similarly as in the embodiment described above. Moreover, circular edges 35 are provided on the circumference adjacent to the outsides of the elastic pieces 34 (the outsides in the axial direction of the wheel 30).

In the present embodiment, since the elastic pieces 34 are easily deformed by a relatively smaller external force similarly as in the embodiment described above, the elastic wheel can be used for implements for children or beginners. In addition, since the circular edges 35 have less deformation than the elastic pieces 34, they can play a role as the edges in skies when the elastic wheel 30 is used for a pair of skis. Thus, this wheel can display more superior turning and stopping functions than the elastic wheel 20 shown in FIG. 6.

Figure 9:
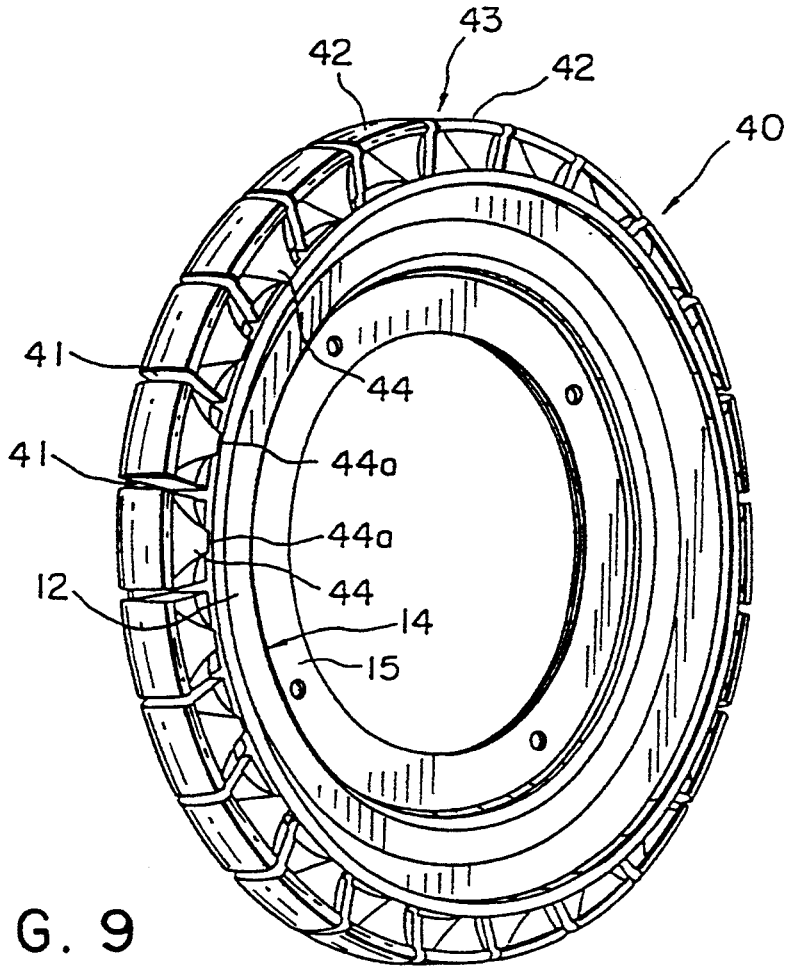
FIG. 9 is a perspective view showing the exterior appearance of a fourth embodiment of the elastic wheel according to the invention.
Figure 10:
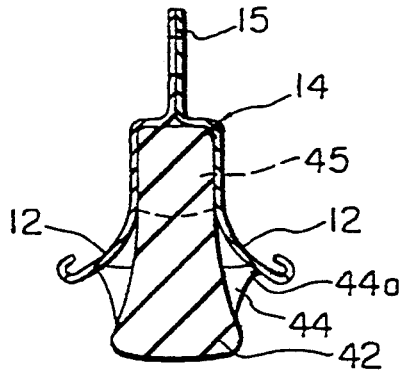
FIG. 10 is a partial sectional view of the elastic wheel shown in FIG. 9.
Figure 11:
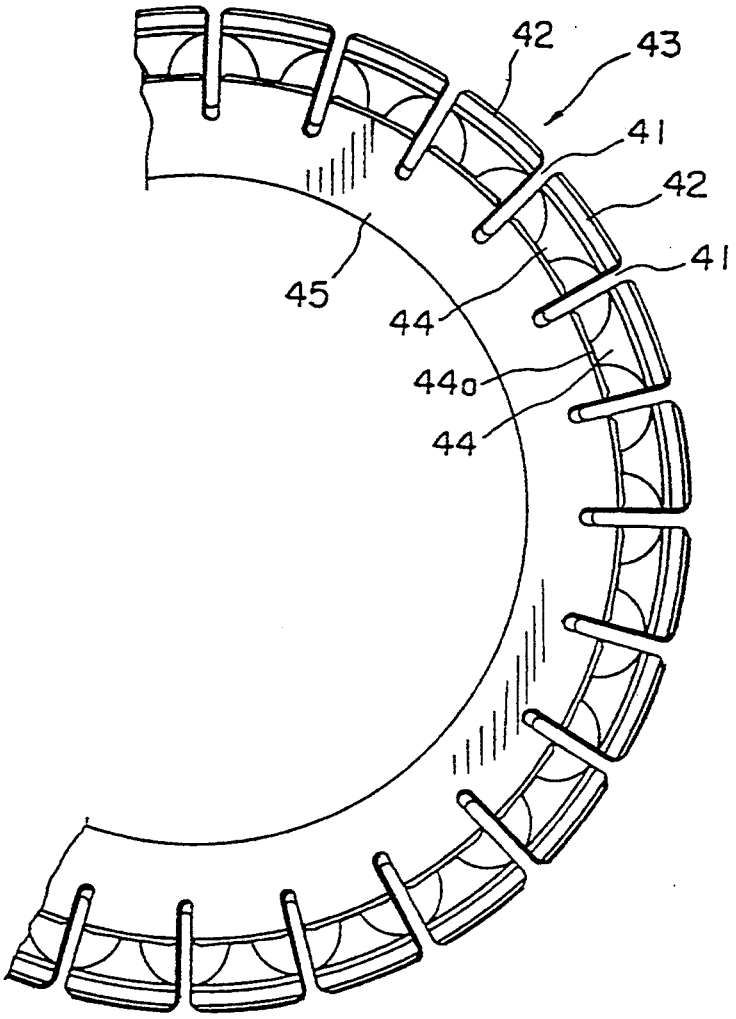
FIG. 11 is a side view showing a part of the tire part of the elastic wheel shown in FIG. 9.

FIGS. 9 to 11 show a fourth embodiment of the invention.

An elastic wheel 40 according to the invention is provided with a tire part 43 having a plurality of elastic pieces 42 which are formed by providing a plurality of slits 41 radially in the outer periphery at equal pitch intervals, as shown in FIG. 11. The tire part 43 further has elastic projections 44 extending outwardly from both sides of each of the elastic pieces 42.

Each of the elastic projections 44 is substantially in the form of a 3-sided pyramid which is made wider at the portion connected to the elastic piece 42 and narrower at the end. The elastic projections 44 are of such construction that when the tire part 43 is mounted on the circular rim part 14, the ends 44*a* of the elastic projections are brought into abutting engagement with the inner wall surfaces of the rims 12. Reference 45 designates the base end portion of the tire part 43.

In the present embodiment, when the elastic wheel 40 is inclined or subjected to a transversal external force, simultaneously with the elastic deformation of the elastic pieces 42, the elastic projections 44 are elastically deformed due to the abutting engagement with the inner wall surfaces of the rims 12. The elastic deformations of the elastic projections 44 relieve impact loads applied to the elastic pieces 42 to thereby prevent any cracks from occurring in the connecting portions between the elastic pieces 42 and the base end portions 45 and any damage to the elastic pieces 42.

The elastic projections 44, which are substantially in the form of 3-sided pyramids, cause an increase in a repulsion against the elastic deformations as the degree of deformations thereof is increased, whereby any excess elastic deformations of the elastic pieces 42 can be limited.

The elastic wheel of the present embodiment is suitable for the case where a relatively greater external thereon force is exerted thereon, and provides superior effects when it is used for skis for advanced skiers who carry out acute turning operation and sudden stops.

Further, adjustment of the configuration of the elastic projections 44 enable the degree of deformations of the elastic pieces 42 to be easily adjusted, and therefore a ski implement with a function suitable for the ability of the skier can be obtained.

Figure 12:
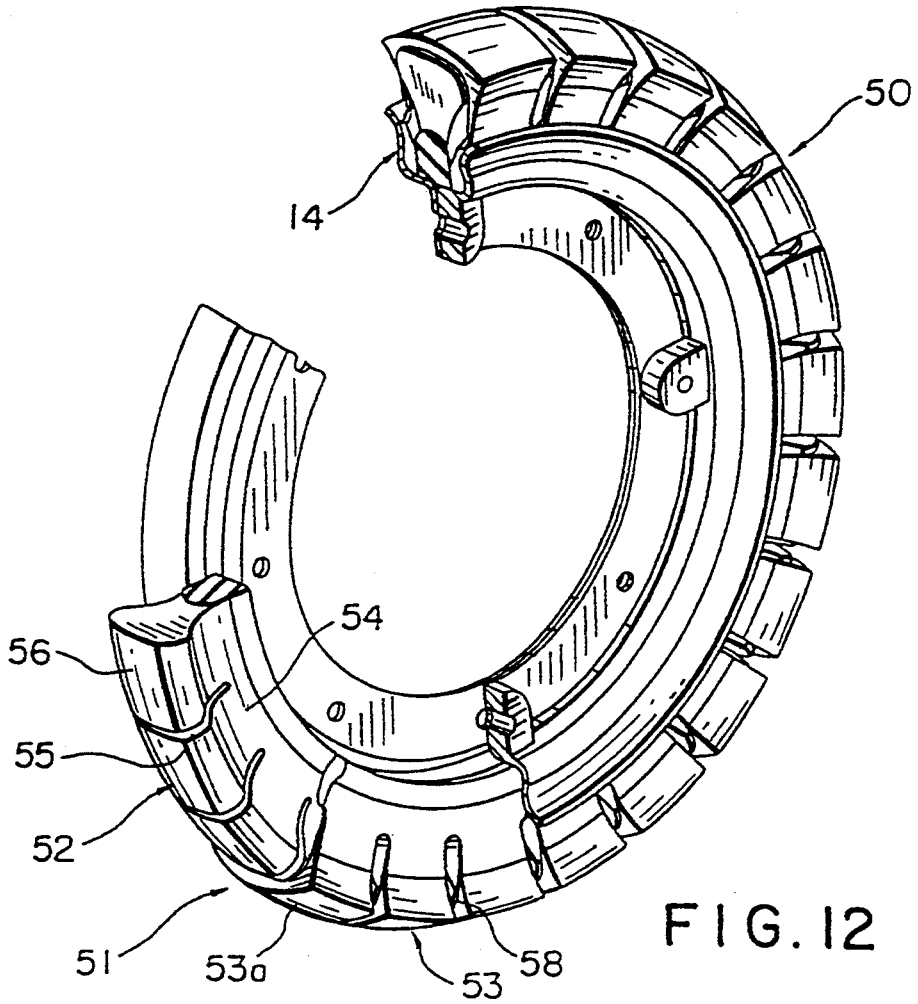
FIG. 12 is a perspective view, partially broken away, showing the external appearance of a fifth embodiment of the present invention.
Figure 13:
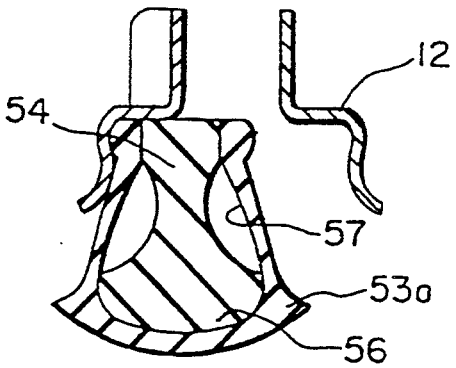
FIG. 13 is a partial sectional view of the elastic wheel shown in FIG. 12.

FIGS. 12 and 13 show a fifth embodiment of the invention.

An elastic wheel 50 according to the invention comprises a tire part 51 which is composed of an inner tire 52 and an outer tire 53 with which the inner tire 52 is covered. The inner tire 52 is constituted by a ring-like base end portion 54 and a plurality of elastic pieces 56 formed on the outer periphery of the base end portion 54 by a plurality of radial slits 55. As shown in FIG. 13, the outer tire 53 is formed in the interior thereof with a housing space in which the inner tire 52 can be housed and is further formed in the outer periphery with radial slits 58 at pitch intervals equal to the slits 55 of the inner tire 52.

The tire part is mounted on the circular rim portion 14 with the inner tire 52 being housed in the interior of the outer tire 53. Thus, each of the elastic pieces 56 of the inner tire 52 is covered with the outer tire 53 and, at the same time, can be elastically deformed together with each of the pieces 53*a* of the outer tire 53.

In the present embodiment, since each of the elastic pieces 56 of the elastic wheel 50 is covered with the outer tire 53, any damage to the elastic pieces 56 can be positively prevented. The elastic wheel 50 can be used for a longer period by suitably replacing the outer tire with a new one.

Figure 14:
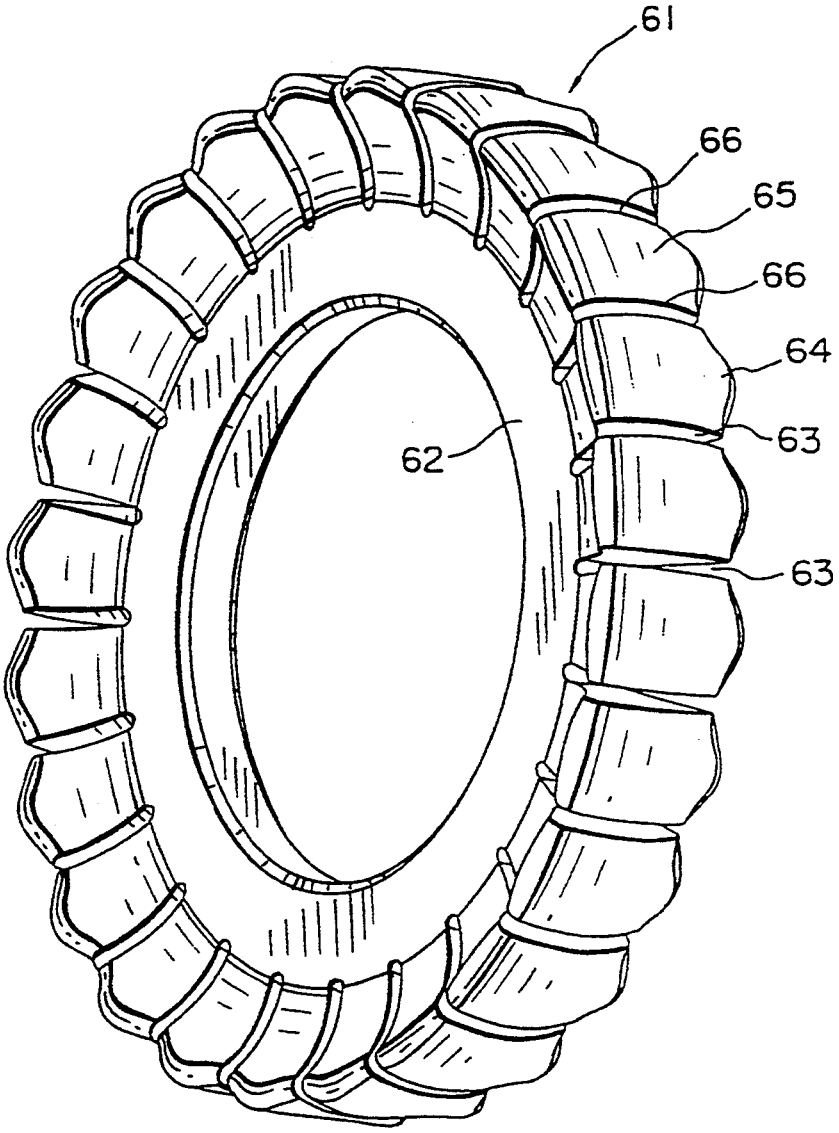
FIG. 14 is a perspective view showing the external appearance of a sixth embodiment of the invention.
Figure 15:
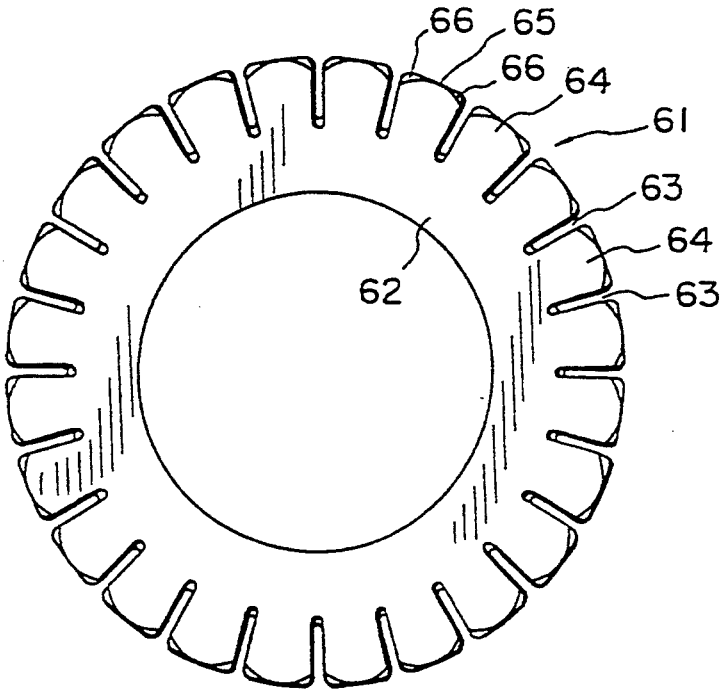
FIG. 15 is a side view of the tire part of the elastic wheel shown in FIG. 14.
Figure 16:
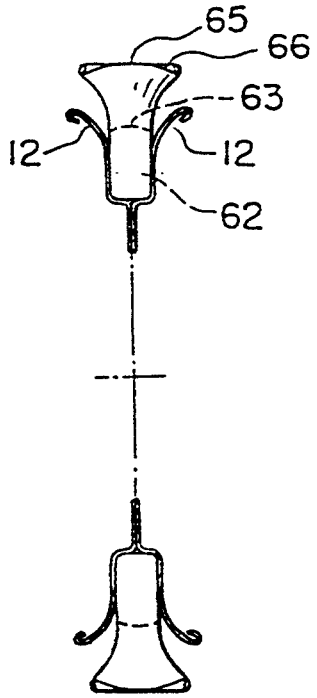
FIG. 16 is a sectional view of the same elastic wheel.

FIGS. 14 to 16 show a sixth embodiment of the invention.

In the present embodiment, a tire part 61 constituting the elastic wheel comprises a circular base end portion 62, a plurality of slits 63 provided radially on the outer periphery of the base end portion 62 at equal pitch intervals and a plurality of elastic pieces 64 formed by the slits 63. Each of the elastic pieces 64 has a planar portion 65 at the middle portion of the top surface thereof and curved surface portions 66 at both sides adjacent the slits 63.

In the present embodiment, since the top surface of the elastic piece 64 is formed as a planar surface portion 65, when the wheel is tilted, the elastic piece 64 can easily be deformed elastically because of the greater distance from the point where the top surface comes into contact with the ground (the lateral end portion of the elastic piece 64) to the position where a load is applied on the elastic piece 64 (substantially the center position of the elastic piece). This means that only tilting of the wheel enables a turning motion to be easily produced without applying a greater load to the wheel in the axial direction (transversely).

Besides, since the lateral sides of the top surface of the elastic piece adjacent the slits 63 have curved surfaces 66, as the elastic pieces 64, which come into contact with the ground due to rotation of the wheel, change one after another, a smooth ground-contacting action to thereby reduce the vibration caused by the elastic pieces 64 is produced.

Figure 17:
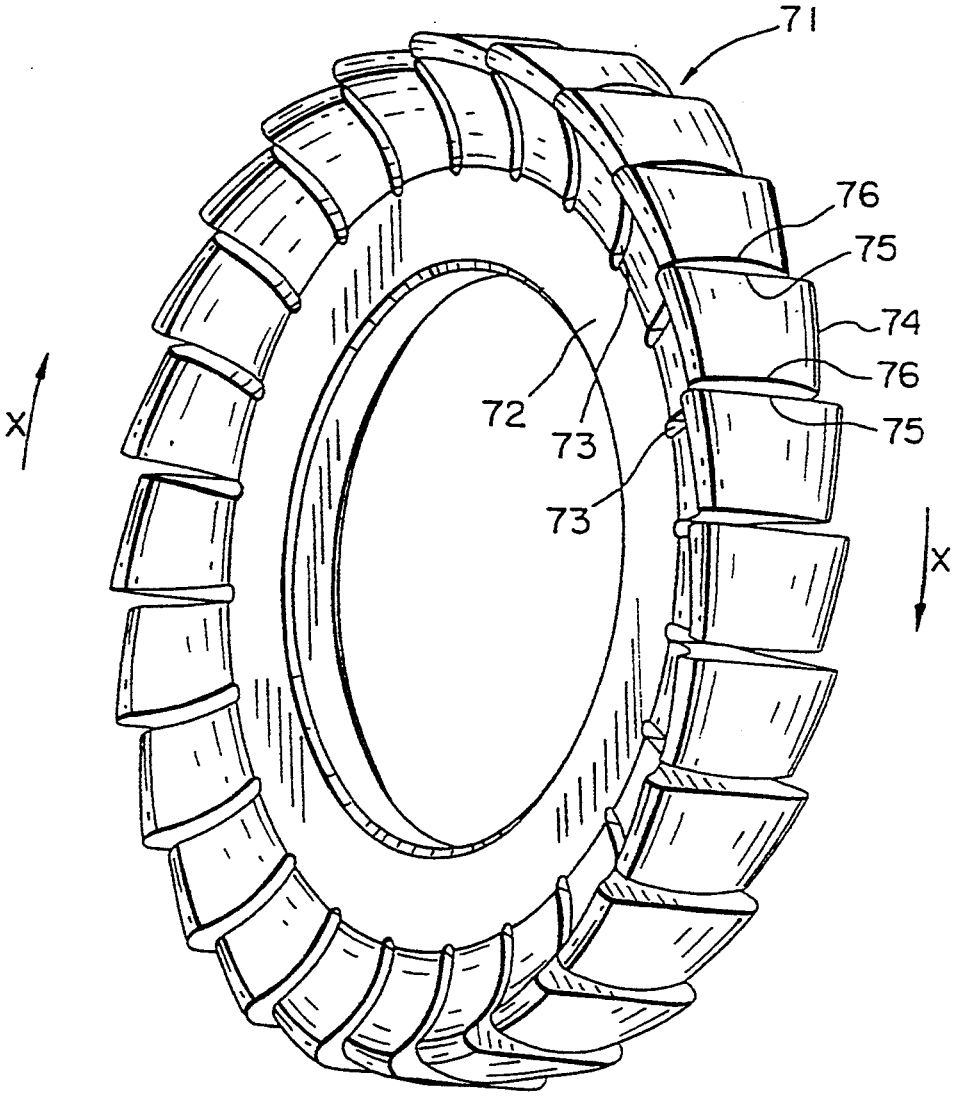
FIG. 17 is a perspective view showing the external appearance of a seventh embodiment of the invention.
Figure 18:
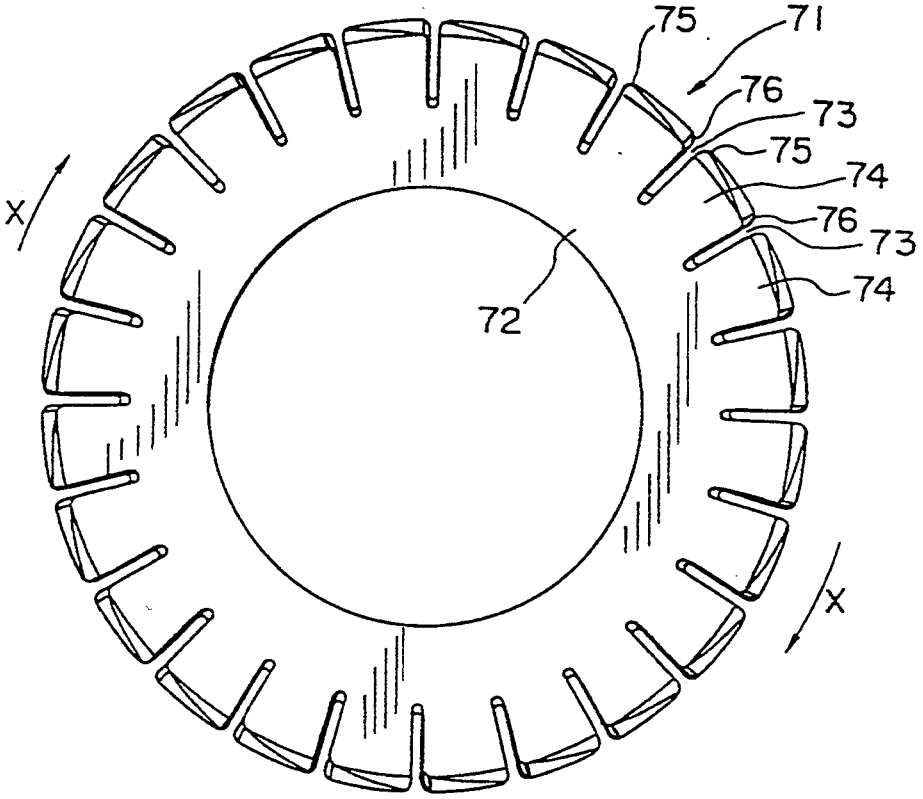
FIG. 18 is a side view of the tire part of the same wheel.
Figure 19:
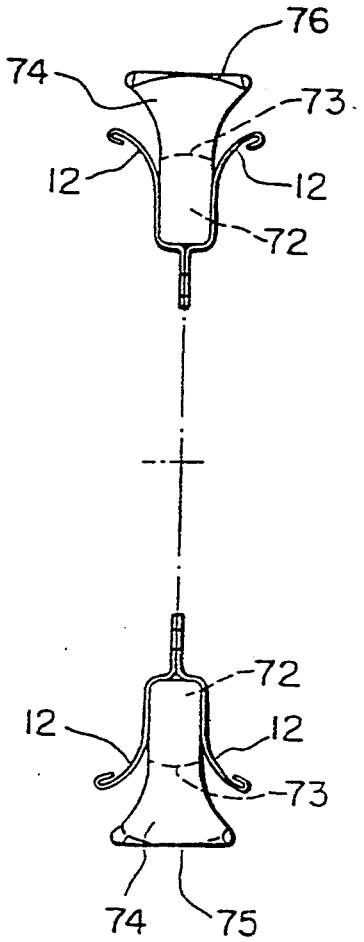
FIG. 19 is a sectional view of the same elastic wheel.

FIGS. 17 to 19 show a seventh embodiment of the invention.

The present embodiment is a modification of the sixth embodiment as described above, wherein an elastic piece is formed at the top thereof with a curved surface portion only in the front lateral end of slits as viewed in the direction of rotation of the wheel.

That is, as shown in the drawings, a tire part 71 constituting the elastic wheel comprises a circular base end portion 72, the plurality of slits 73 provided radially on the outer periphery of the base end portion 72 at equal pitch intervals and a plurality of elastic pieces 74 formed by the slits 73.

Each of the elastic pieces 74 is provided at the top surface thereof with a planar surface and a curved surface, said planar surface being formed at the lateral end of the slit 73 opposite the direction of rotation, if the wheel is rotated in the arrow-marked direction X, and substantially at the central portion thereof. Furthermore, the curved surface 76 is provided at the lateral end of the slit in the direction of the rotation of the wheel.

With the present embodiment, only tilting of the wheel enables a turning motion to be easily produced, similarly as in the preceding sixth embodiment. In addition, the greater planar surface of the elastic piece 74 as compared with that of the preceding embodiment facilitates the deformation thereof and reduces the vibration thereof. Moreover, an arrangement of the curved surface 76 at the lateral end of the slit in the direction of rotation enables a smooth ground-contacting motion to be performed as the elastic piece 74 first comes into contact with the ground and the occurrence of the vibration of the elastic piece 74 to be reduced.

Figure 20:
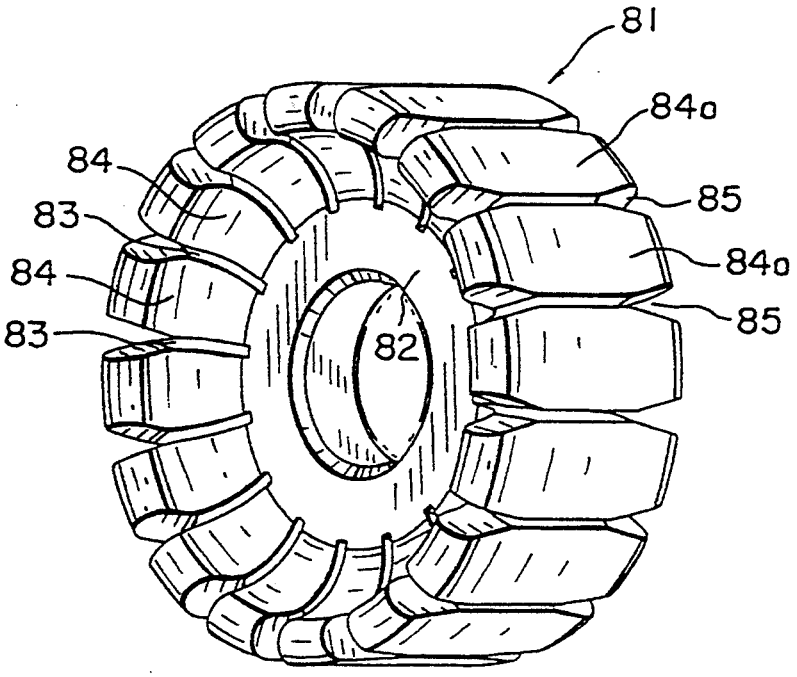
FIG. 20 is a perspective view showing the external appearance of a eighth embodiment of the invention.

FIG. 20 is a perspective view showing the exterior appearance of an eighth embodiment of the invention.

In the present embodiment, the width of a tire part 81 constituting the wheel is made relatively greater and the top surface of each of the elastic pieces is made planar. As shown in the drawing, the tire part 81 includes a circular base end portion 82 and a plurality of elastic pieces 84 divided by a plurality of radial slits 83 provided on the outer periphery of the base end portion 82 and formed at equal pitch intervals thereon.

Each of the elastic pieces 84 has a top surface 84*a*, which is formed as a substantially rectangular plane and is provided at the ends of the peripheral edges with cut parts 85 larger in width than the slits 83.

In the present embodiment, since the elastic piece 84 has a top surface 84*a* forming a wide plane, only tilting of the wheel enables the elastic piece to be easily deformed elastically so the turning motion of the wheel can be smoothly performed. Besides, the turning radius can be made smaller.

Further, the provision of the cut portions 85 removes interference between the adjacent elastic pieces 84 when they are elastically deformed.

Figure 21:
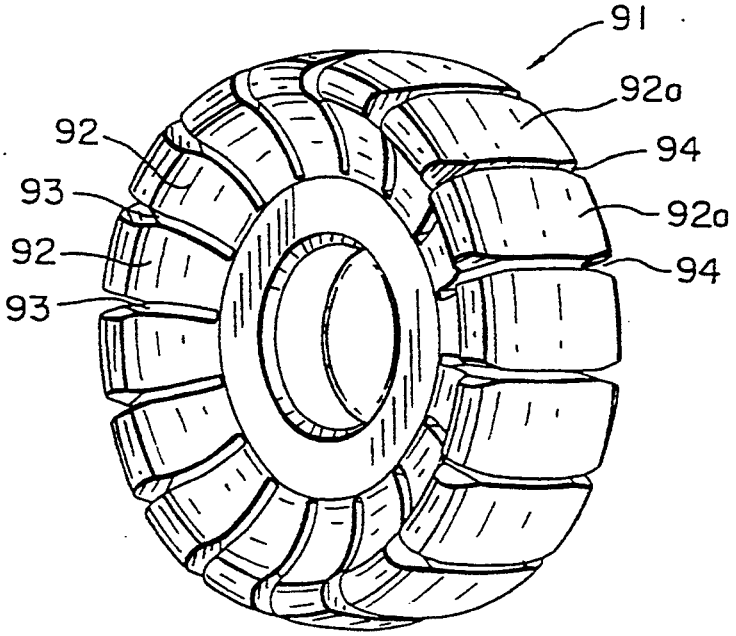
FIG. 21 is a perspective view showing the external appearance of a ninth embodiment of the invention.

FIG. 21 is a perspective view showing the exterior appearance of a ninth embodiment of the invention.

The present embodiment is a modification of the preceding eighth embodiment, in which the width of a tire part 91 is similarly made wider and elastic pieces 92 are provided at the ends of the peripheral edges with cut portions 94 greater in width than the slits 93.

In the present embodiment, the top surface 92*a* of the elastic piece 92 is formed as a surface curved in the axial direction. This means that the elastic deformation of the elastic piece 92 is smaller as compared with the preceding eighth embodiment in which the top surface of the elastic piece is formed as a planar surface. Accordingly, with the wheel according to the present embodiment, tilting of the wheel and further application of a load at the side opposite the tilted side of the wheel provide a desired elastic deformation and cause a turning motion.

The wheel according to the present embodiment is suited for a pair of skis used by a relatively experienced skier who can perform a motion which adds a load to the wheel.

FIGS. 22 to 29 show a tenth embodiment of the invention.

Figure 22:
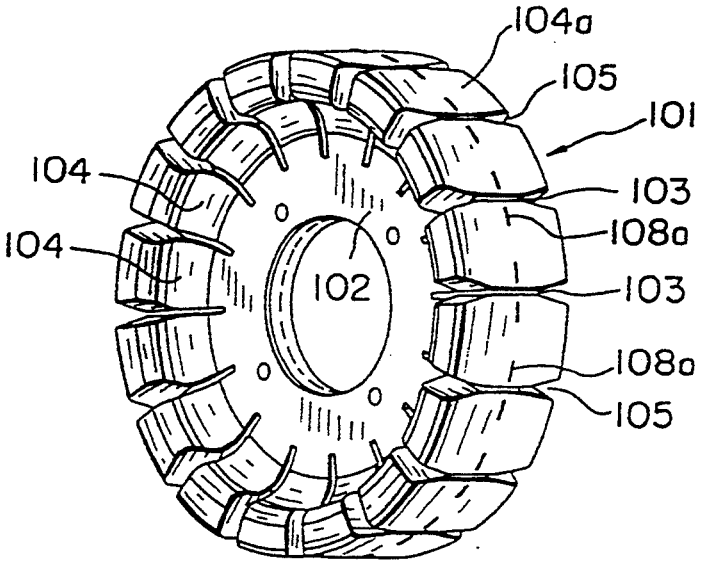
FIG. 22 is a perspective view showing the external appearance of a tenth embodiment of the invention.

FIG. 22 is a perspective view showing the exterior appearance of a tire part 101 of the elastic wheel according to the present embodiment. Similarly as the tire part shown in FIG. 20, the tire part 101 comprises a circular base end portion 102 and a plurality of elastic pieces 104 formed by providing slits 103 on the outer periphery of the base end portion 102 at equal pitch intervals, and each of the elastic pieces 104 is made planar at the top surface thereof and provided with the cut parts 105 at the ends of the peripheral edges.

In the present embodiment, a core disk 107 is further embedded in the tire part 101 and includes a plurality of disk pieces 106 radially arranged perpendicularly to the axis of the tire part 101.

Figure 23:
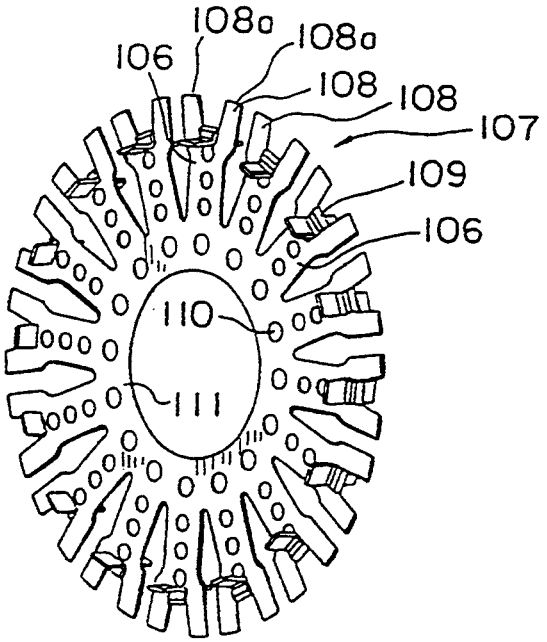
FIG. 23 is a perspective view showing the external appearance of an example of a core disk of the wheel shown in FIG. 22.

As shown in FIG. 23, the core disk 107 is produced by forming a ring-like sheet metal or synthetic resin sheet and has radially arranged elongated disk pieces of the same number as that of the elastic pieces of the tire part 101. Each of the disk pieces 106 has at the front end two branched members 108 and a receiving washer 109 is secured between the two members 108 perpendicularly to the disk pieces 106. Each of the disk pieces is provided with holes 110 to reduce the weight to a degree such that the strength thereof will not be decreased. Adjustment of the holes 110 in size and number permits adjustment of the elastic pieces 104 in the degree of the elastic deformation.

The core disk 107 is provided inwardly in the middle of the tire part 101 perpendicularly to the axis of the wheel, and the base end portion 111 of the core disk 107 extends to the inner peripheral edge of the base end portion 102 of the tire part 101. The end 108*a* of the core disk 107 extends to the same position as the position where the top surface 104*a* of the tire part 101 exists or to a position where it projects somewhat therefrom.

The base end portion 102 of the tire part 101 is mounted on the circular rim 112 as a wheel supporting means together with the base end portion 111 of the core disk 107, and the circular rim 112 is connected to a hub 114 for a wheel shaft through a disk-like connection 113.

The operation of the present embodiment as constituted above will be described with reference to FIGS. 25 to 29.

Figure 24:
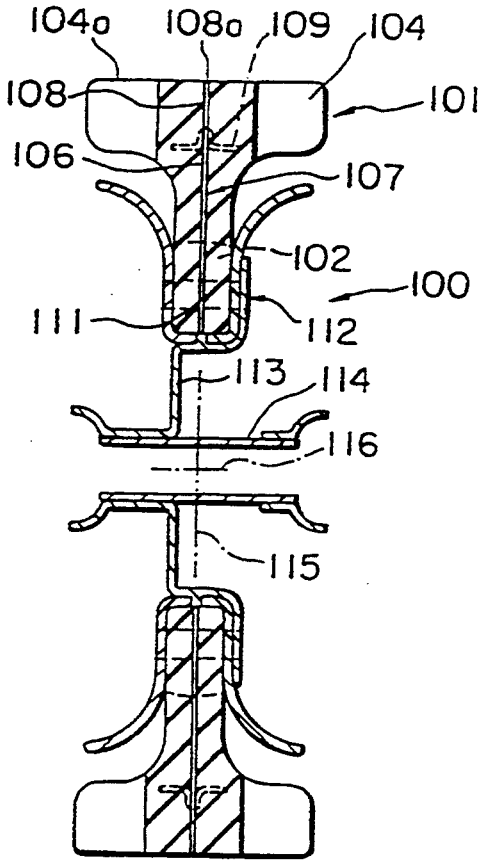
FIG. 24 is a sectional view of the same elastic wheel.
Figure 25:
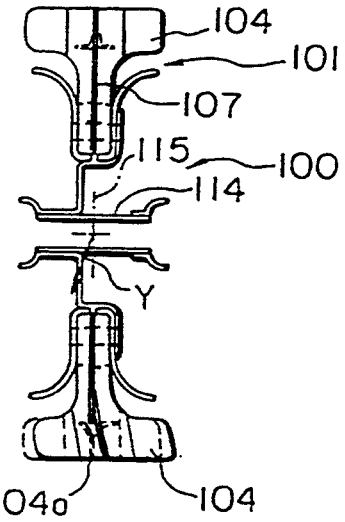
FIG. 25 is a sectional view showing the action of the elastic wheel.
Figure 26:
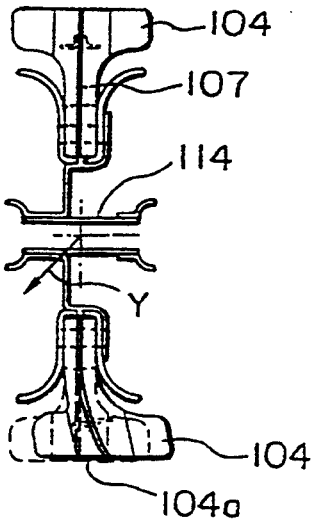
FIG. 26 is a sectional view showing the action of the same elastic wheel.

Application of a force Y to the elastic wheel 100 in the state shown in FIG. 24 in the direction intersecting with a surface of rotation 115 of the wheel causes the elastic piece 104 in contact with the ground to be elastically deformed, as shown in FIG. 25, so that the surface of rotation 115 of the wheel is displaced to the side opposite the direction of the applied force Y. Further application of a force larger than the force Y makes the degree of elastic deformation of the elastic piece 104 larger, as shown in FIG. 26, and causes the body of a skier wearing a pair of skis provided with the elastic wheel 100 to be displaced in the direction away from that of the force Y.

Figure 27:
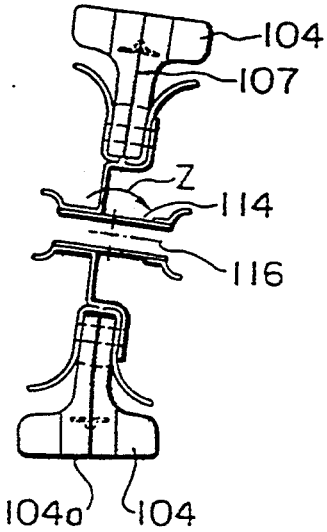
FIG. 27 is a sectional view showing the action of the same elastic wheel.
Figure 28:
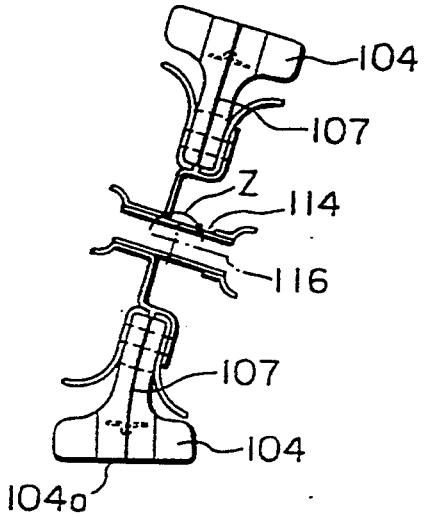
FIG. 28 is a sectional view showing the action of the same elastic wheel.
Figure 29:
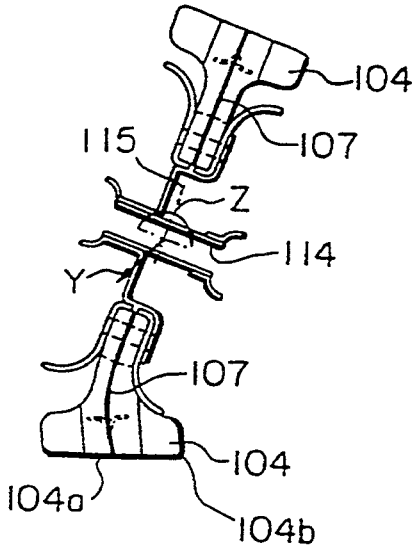
FIG. 29 is a sectional view showing the action of the same elastic wheel.

Subsequently, as shown in FIGS. 27 and 28, application of a force Z in the direction allowing the axis of rotation 116 of the wheel to be tilted, causes the elastic wheel 104 to be elastically deformed, thereby tilting the elastic wheel 100. Application of a force Y intersecting with the surface of rotation 115 of the wheel in this state causes the elastic piece 104 to be deformed to the maximum, as shown in FIG. 29, and an edging motion to occur with a point indicated by reference 104*b* among the ground contacting portions of the elastic piece 104 as a center. Thus, the wheel 100 is turned to the right while sideslipping to the left with respect to the drawing, assuming that the wheel 100 is advanced in the direction perpendicular to the drawing.

In this way, when causing the elastic wheel 100 to perform a turning motion, the elastic members 104 and the core disk 107 are elastically deformed largely with the respective base end portions 102 and 111 as a base point. In this case, the present embodiment, in which the core disk 107 is embedded in the interior of the tire part 101, provides superior effects as described below.

(i) The strength against bending and torsion can be increased as compared with that of an elastic wheel integrally formed using a rubber member. Furthermore, the loading capacity is increased so that a buckling of the tire part can be prevented.

(ii) Since the elastically restoring force of the core disk can be utilized in addition to that of the elastic piece, the force which restores the wheel to its original state after the elastic deformation becomes greater.

(iii) If the ends 108*a* of the core disk 107 are slightly extended from the top surfaces 104*a* of the elastic pieces 104, the extended ends 108*a* will bite into the surface of the ground to thereby prevent the wheel from slipping.

Moreover, wear of the tire part 101 can be reduced.

(iv) The mounting of the receiving washer 109 forms the core in the direction of width of the elastic piece 104, which further increases the load resisting performance of the elastic piece 104.

Figure 30:
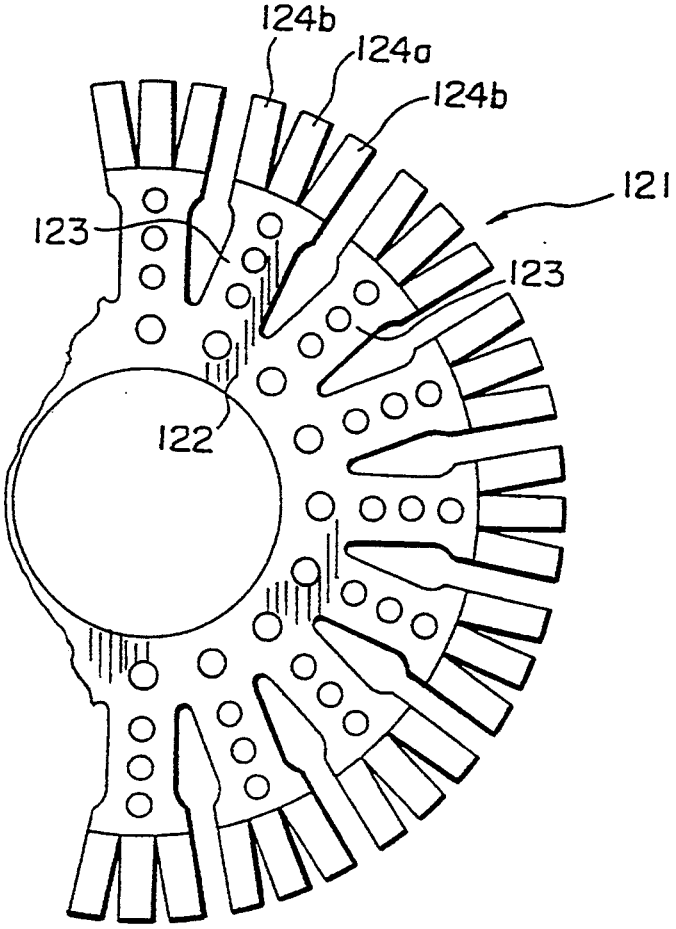
FIG. 30 is a fragmentary side view showing another example of the core disk.
Figure 31:
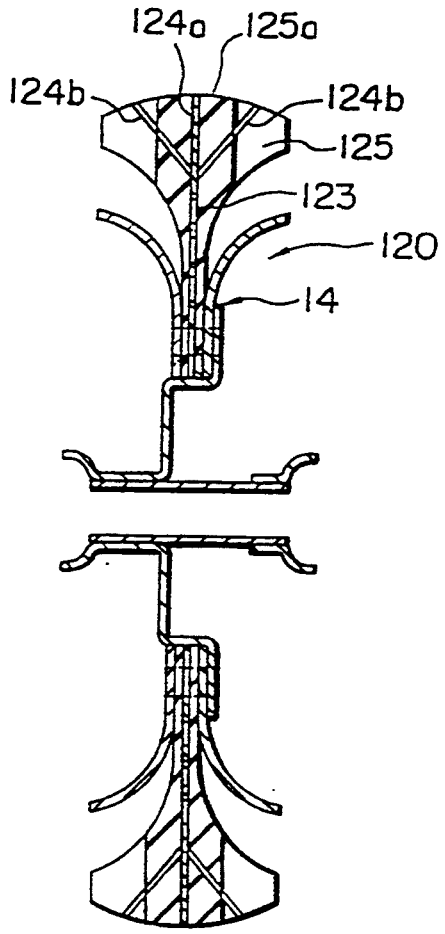
FIG. 31 is a sectional view showing an eleventh embodiment of the invention using the core disk illustrated in FIG. 30.

FIGS. 30 and 31 are views showing an eleventh embodiment of the invention.

A core disk 121 in this embodiment includes a plurality of disk pieces 123 radially arranged on the outer periphery of a ring-like base end portion 122, and each of the disk pieces 123 is formed at its end with three pieces which consist of a middle piece 124*a* and two side pieces 124*b* provided at both sides of the middle piece. The two outer pieces, between which the middle piece 124*a* exists, are bent in the directions opposite to each other, as shown in FIG. 31.

In addition, in the present embodiment, the top surface 125*a* of the elastic piece 125 is of a section of a circular arc which is inclined smoothly to both side ends. This permits an enhancement in the straight running performance of the elastic wheel 120.

In the elastic wheel 120 according to the invention, the end of the middle piece 124*a* and the ends of the side pieces 124*b* of the disk piece 123 bent in the directions away from each other are arranged on the top surface 125*a* of each of the elastic pieces 125 in the form of left—center—right (or right—center—left) along a diagonal line. With this arrangement, when a skating motion is performed using the elastic wheel 120 according to the present embodiment, the end portions of the disk pieces 123 appear one after another in the top surface 125*a* of each of the elastic pieces 125 at the positions where it comes most often into contact with the ground, thereby preventing any inclined wear from occurring on the surface of the tire part.

Figure 32:
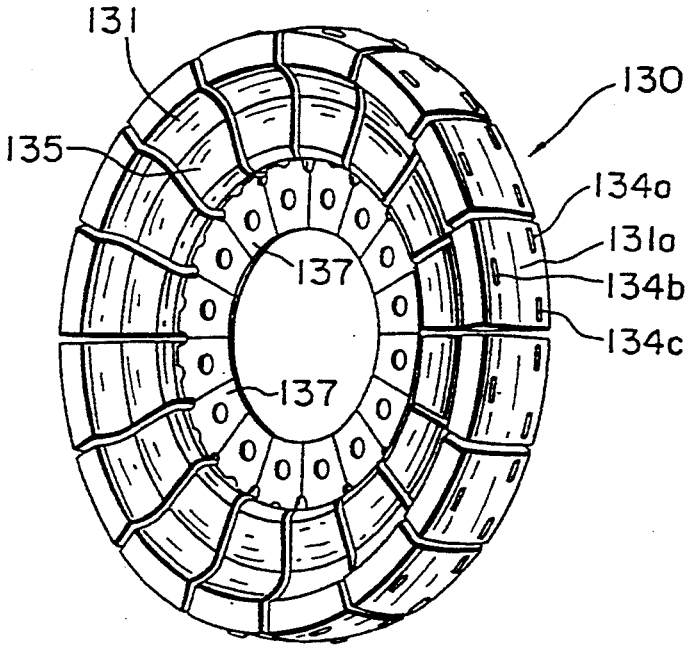
FIG. 32 is a perspective view showing the external appearance of a twelfth embodiment of the invention.
Figure 33:
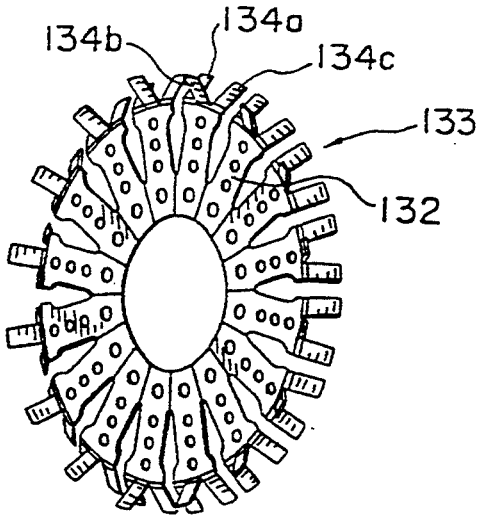
FIG. 33 is a perspective view showing the external appearance of an example of the core disk of the elastic wheel shown in FIG. 32.
Figure 34:
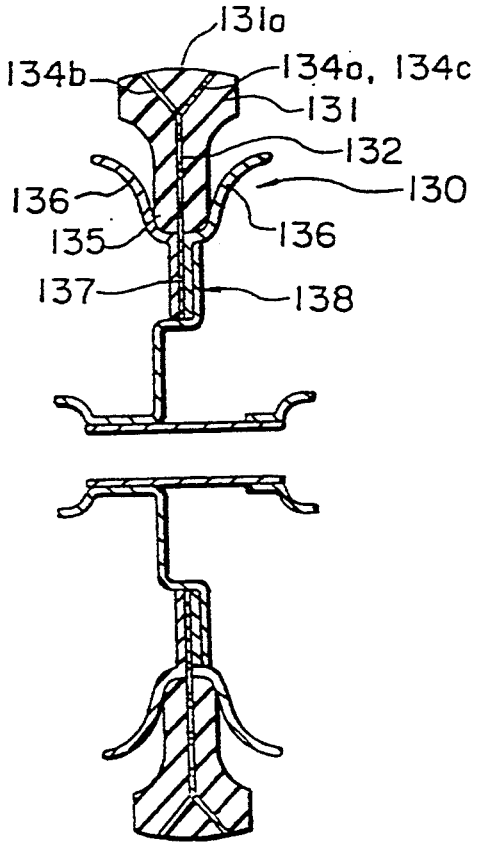
FIG. 34 is a sectional view of the same elastic wheel.

FIGS. 32 to 34 are views showing a twelfth embodiment of the invention.

In the present embodiment, elastic pieces 131 and disk pieces 132 are fabricated independently piece-by-piece, and an elastic wheel 130 is constituted by arranging a plurality of these pieces on the circumference.

That is, as shown in FIG. 33, the core disk 133 is constituted by arranging a plurality of elongated plate-like metal disk pieces 132 on the circumference, and each of the disk pieces 132 has at the end thereof an elastic piece 131 made of rubber secured thereto.

The end of each of the disk pieces 132 branches in three pieces 134*a*, 134*b* and 134*c*, and the middle piece 134*b* and two pieces 134*a*, 134*b* at both sides thereof are bent oppositely to each other.

As shown in FIG. 34, the core disk 133, to which the elastic pieces 131 are secured, allows the base end portions 135 of the elastic pieces 131 to be mounted on circular rims 136, and the base end portion 137 of the core disk 133 further extends inwardly after passing through the elastic pieces 131 and is held directly between the circular rims 136 which are connected to a wheel supporting means 138.

The elastic wheel 130 according to the present embodiment, in which the elastic pieces 131 and the disk pieces 132 are produced independently piece by piece, is inexpensive in the costs for molds and sheet metals, as compared with the wheel having the elastic pieces and disk pieces formed integrally, whereby the manufacturing cost thereof can be reduced.

Further, since the ends of the disk pieces 132 bent oppositely to each other are arranged on the top surface 131*a* of each of the elastic pieces 131, wear of the tire part can be reduced, similarly as in the preceding embodiment.

Figure 35:
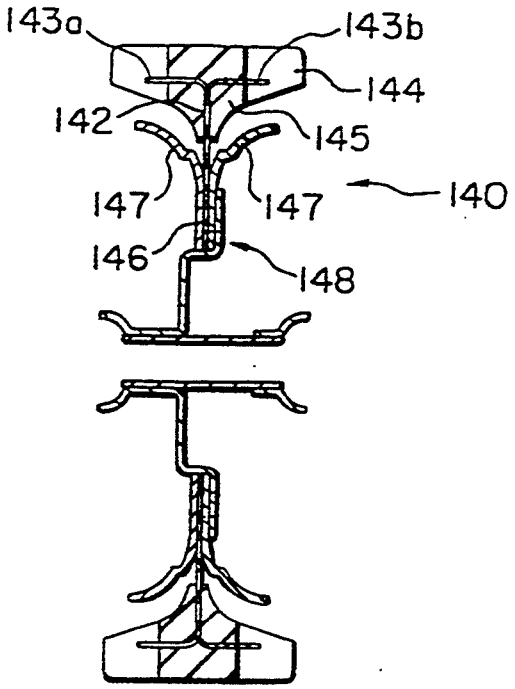
FIG. 35 is a sectional view showing a thirteenth embodiment of the invention.
Figure 36:
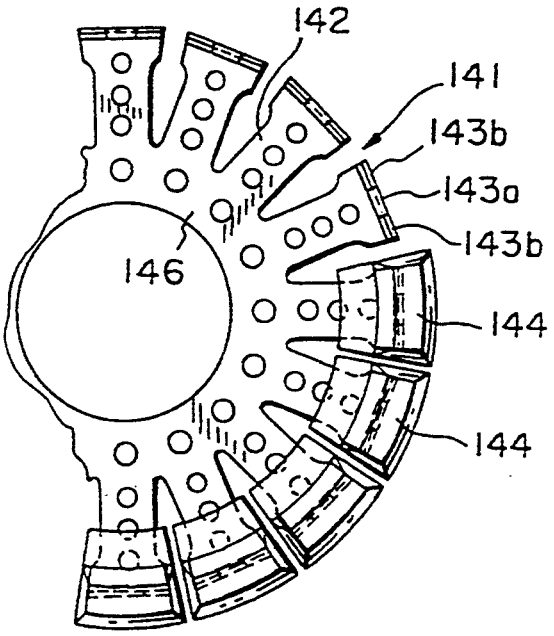
FIG. 36 is a fragmentary side view showing a combination of the core disk and the elastic piece.

FIGS. 35 and 36 show a thirteenth embodiment of the invention.

In this embodiment, as shown in FIG. 36, the dimension of width of each of disk pieces 142 arranged radially and constituting a core disk 141 is made larger. Each of the disk pieces 142 branches at the end thereof in three pieces, a central piece 143*a* and two side pieces 143*b* at both sides thereof, which are bent substantially horizontally in the opposite direction to each other.

Elastic pieces 144 are formed independently from each other and the base end portion 145 thereof has such a dimension that it is mounted up to a position on the way of the disk piece 142. As shown in FIG. 35, the elastic wheel 140 is so assembled that after the elastic pieces 144 are mounted on the ends of the respective disk pieces 142, the base end portion 146 of the core disk 141 extending over the elastic pieces 144 is held directly between two circular rims 147, and the base end portion 146 of the core disk and the circular rims 147 are connected in one piece to a wheel supporting means 148.

In the present embodiment, since the end side pieces 143*a*, 143*b* of each of the disk pieces 142 are horizontally bent, the dimensions of width of the side pieces in the horizontal direction become greater, thereby increasing the load carrying capacity of each of the elastic pieces 144. In addition, application of a relatively smaller force makes possible elastic deformations of the elastic pieces 144.

Further, since the base end portion 145 of each of the elastic pieces 144 is not held between the circular rim parts 147 and only the base end portion 146 of the core disk 141 is held therebetween, the disk piece 142 is directly deformed elastically when an external force is applied to the elastic piece 144. Accordingly, application of a relatively smaller force enables the elastic wheel 140 to be elastically deformed.

Figure 37:
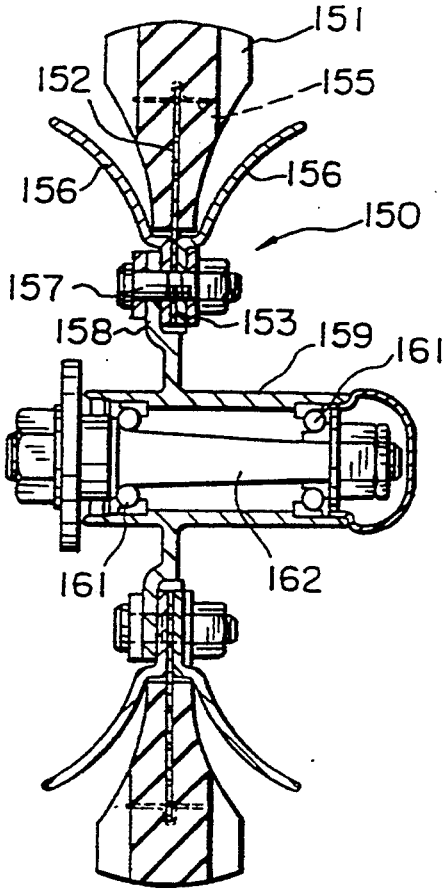
FIG. 37 is a sectional view showing a fourteenth embodiment of the invention.
Figure 38:
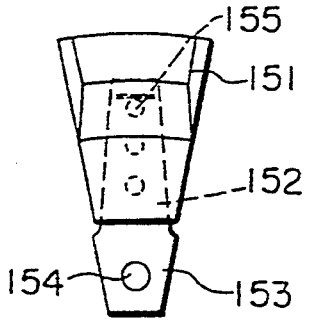
FIG. 38 is a side sectional view showing a combination of the elastic piece and the core disk piece.

FIGS. 37 and 38 are views showing a fourteenth embodiment of the invention.

Referring to the drawings, reference numeral 151 indicates elastic pieces which are each formed independently from each other. Reference numeral 152 designates disk pieces which are provided in the same number as the elastic pieces 151, and each is inserted in the interior of the elastic piece 151.

Each of the disk pieces 152 is provided at the base end portion 153 with an opening 154 and has, at the outer end portion, a receiving washer 155 attached thereto so as to extend perpendicularly to the disk piece 152. The disk pieces 152, each having the elastic piece 151 mounted on the end thereof, are arranged on the outer periphery at equal pitch intervals and each have the respective base end portion 153 held between two circular rims 156 and are secured to a flange portion 158 provided on a hub 159 by bolts 157 inserted through the openings 154 of the base end portions 153 and the circular rims 156. The hub 159, in turn, is rotatably mounted on a wheel shaft 162 through a bearing 161.

In the elastic wheel 150 according to the present embodiment, since the elastic members 151 and the core disks 152 are independently formed one-by-one, the production cost can be reduced. Moreover, since the base end portions 153 of the disk pieces 152 are held directly between the circular rims 156, the elastic deformation of the elastic wheel 150 can be produced by a relatively smaller force, similarly as in the embodiment shown in FIG. 35.

Figure 39:
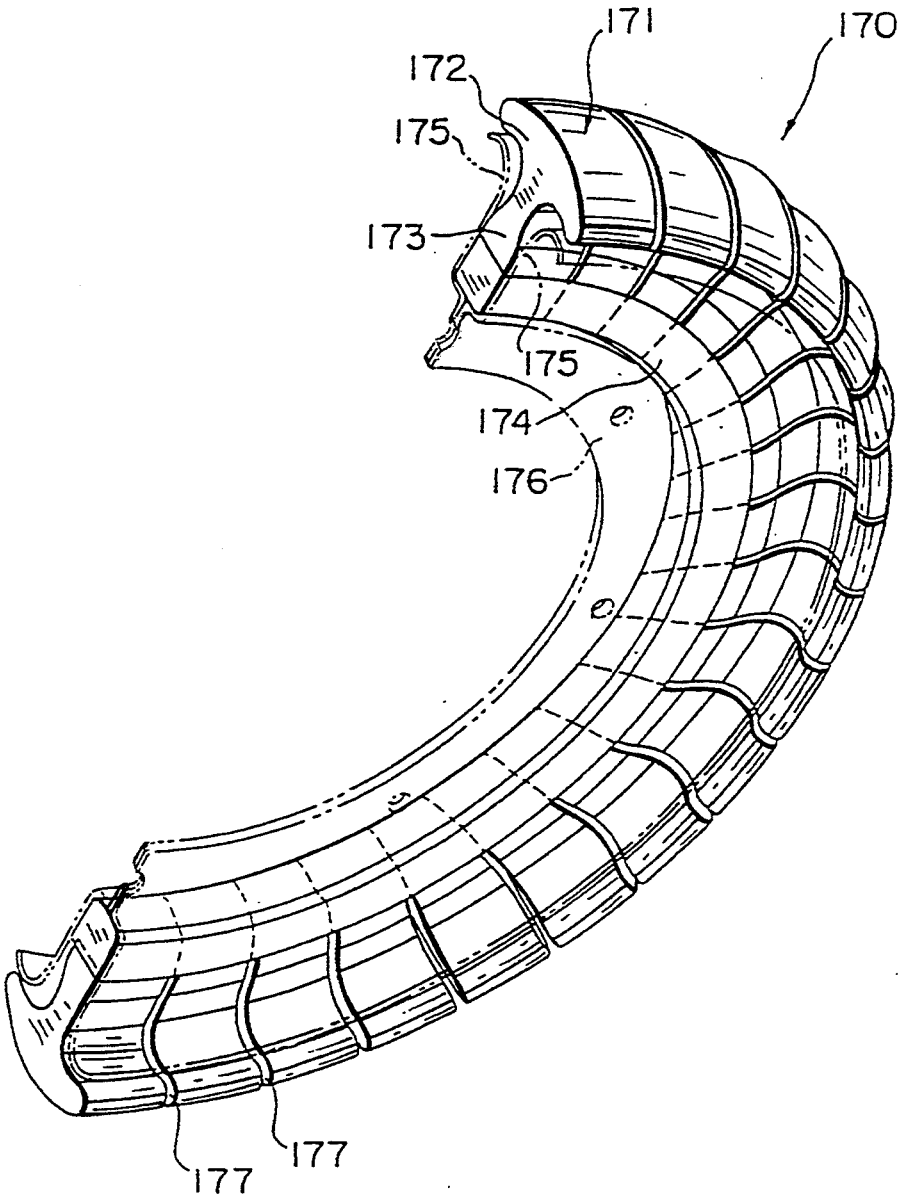
FIG. 39 is a partial perspective view showing a fifteenth embodiment of the invention.
Figure 40:
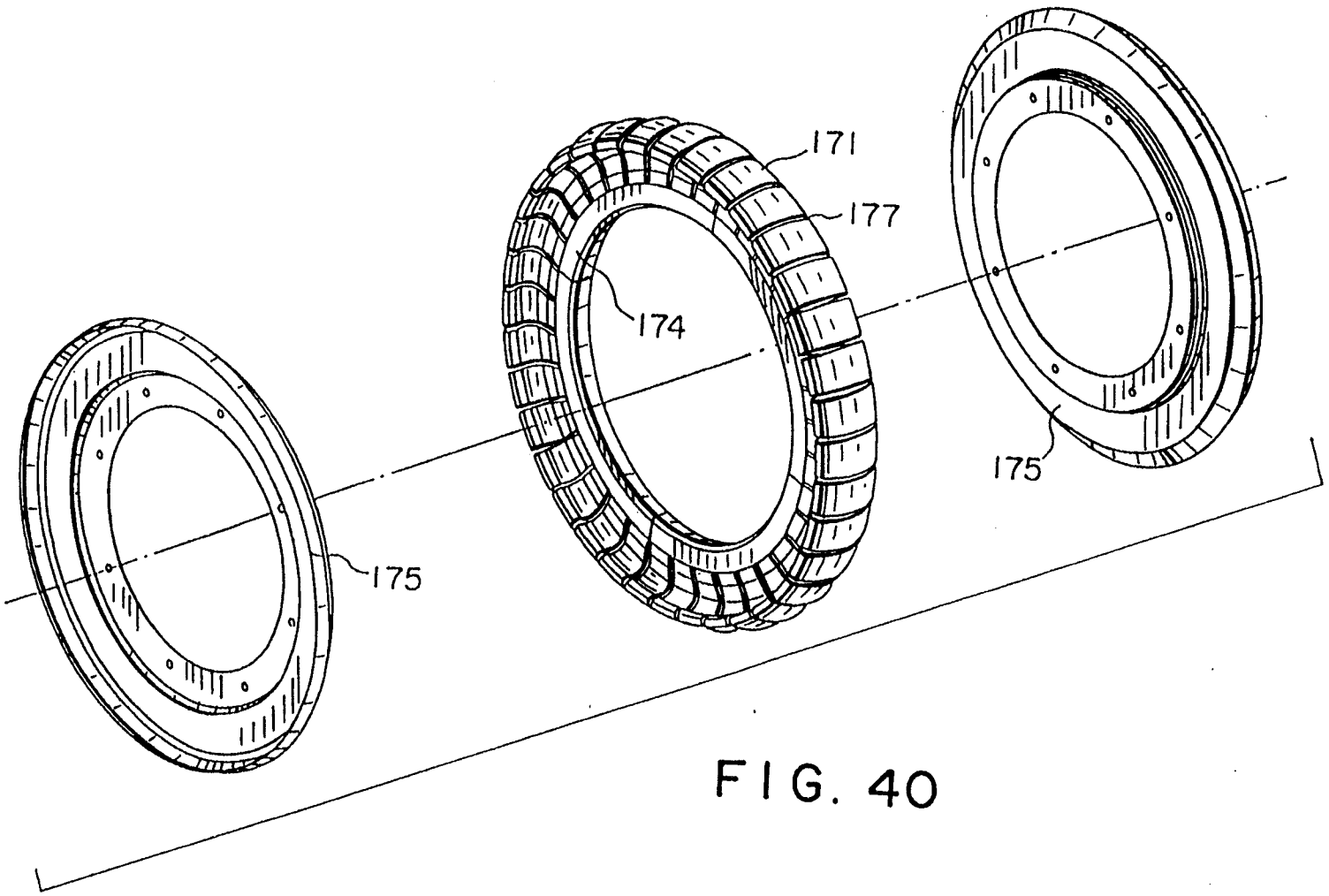
FIG. 40 is an exploded perspective view of the same.

FIGS. 39 to 40 are views showing a fifteenth embodiment of the invention.

Referring to the drawing, reference numeral 171 designates an elastic piece having a section in which the front end portion 172 is greater in transverse width than the base end portion 173. The elastic pieces 171 are independently formed one-by-one and the base end portions 173 thereof are fitted in a holding ring 174 so that they are arranged on the periphery at equal pitch intervals.

The holding ring 174 is further held between two circular rims 175 and secured to a wheel shaft means (not shown) by the rim disks 176 provided on the inner periphery of the circular rims 175. A clearance 177 is provided between the adjacent elastic pieces 171 to avoid their interference with each other.

The elastic wheel 170 of the present embodiment as constituted in this way provides substantially the same action as that in the first embodiment as shown in FIG. 1.

The elastic wheel 170 according to the present embodiment, which has the elastic pieces 171 formed independently one-by-one, permits the production cost to be reduced as compared with the first embodiment. Besides, when the elastic pieces 171 are worn out or damaged, they can be exchanged or repaired in a relatively easy manner.

FIGS. 41 to 44 are views showing a sixteenth embodiment of the invention.

Referring to the drawings, reference numeral 181 designates an elastic member, for example, an elastic tire formed in a ring by a rubber member. The elastic tire 181 has a section in which the dimension of width of the lateral portion 182 of the outer periphery is greater than that of the base end portion 183.

Reference 184 indicates a circular rim part made by a combination of two rims 185 which has a circular groove 186 at the middle thereof. An elastic wheel 180 is assembled by fitting the base end portion 183 of the elastic tire 181 in the circular groove 186 to mount the elastic tire 181 on the circular rim part 184. Furthermore, as shown in FIG. 44, ring-like piano wires may be embedded in the base end portion 183 to ensure the mounting of the elastic tire 181 on the circular rim.

Figure 43:
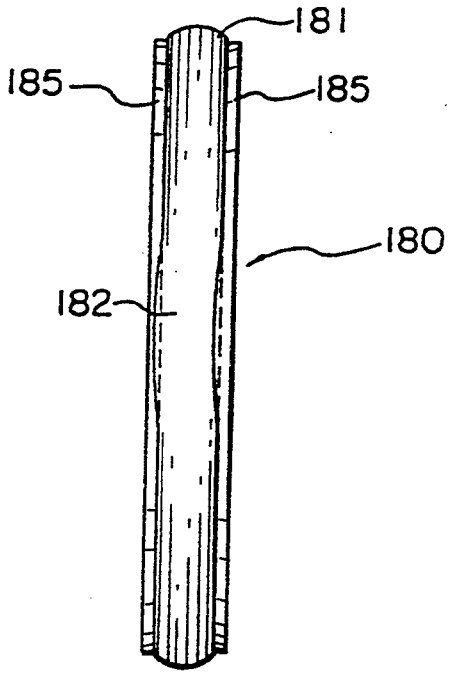
FIG. 43 is a front view showing the action of the embodiment illustrated in FIG. 41.
Figure 44:
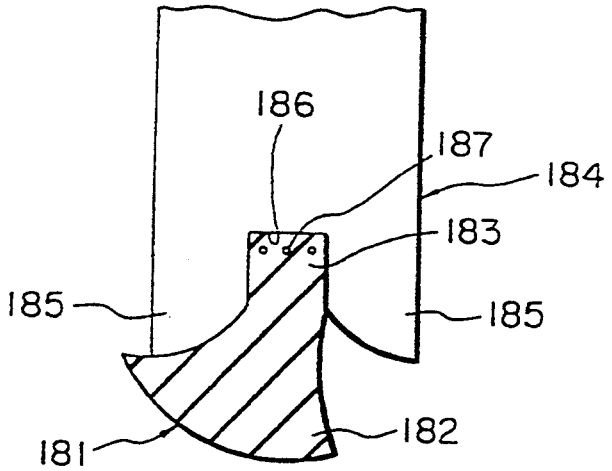
FIG. 44 is a fragmentary sectional view of the same.

In the elastic wheel 180 according to the present embodiment, as shown in FIGS. 43 and 44, the elastic tire 181, when subjected to an external transverse force, is elastically deformed, similarly as in each of the preceding embodiments. This elastic deformation is caused so that the lateral portion 182 of the outer periphery is deformed with the base end portion 183 as a base point, and the deformation of the lateral portion 182 of the outer periphery is possible until it is brought into an abutting engagement with the inner wall of the circular rim part 184.

In this way, the elastic tire 181, as rotated, is elastically deformed in a continuous manner in the portion where it comes into contact with the ground, to thereby enable the elastic wheel 180 to perform a turning motion and a stopping motion.

The elastic wheel 180 of the present embodiment, which facilitates the fabrication of the elastic tire 181, enables the production cost to be further reduced as compared with that of the preceding embodiments. In addition, since the elastic tire 181 is provided with neither slits nor clearance parts, it has an advantage that damages or notches do not easily occur.

Figure 45:
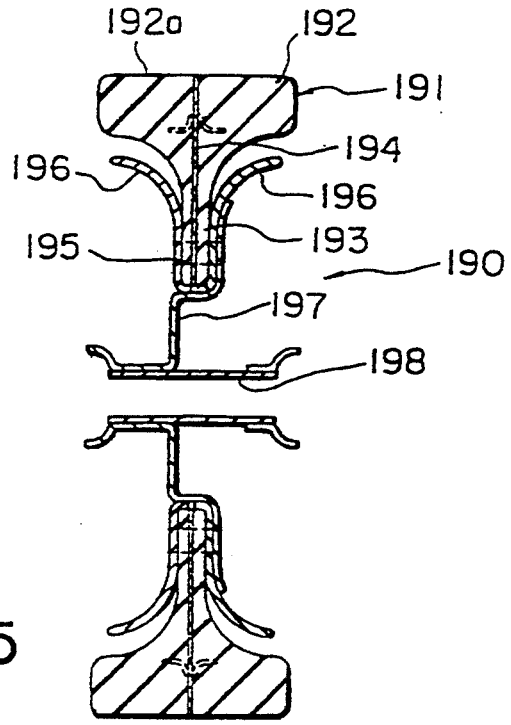
FIG. 45 is a sectional view showing a seventeenth embodiment of the invention.
Figure 46:
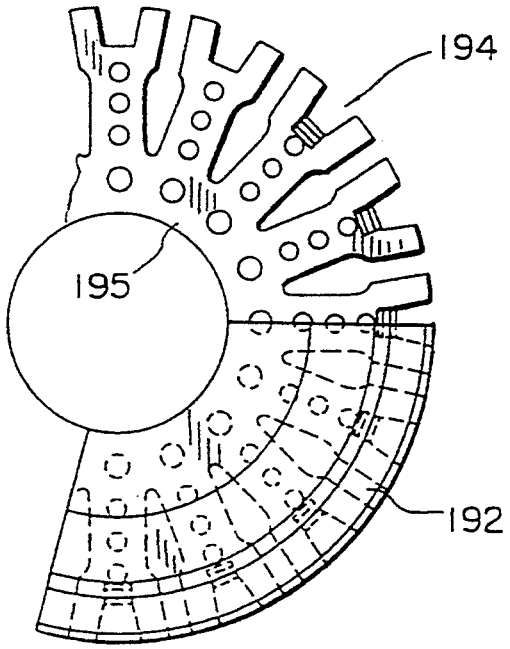
FIG. 46 is a side view showing a further example of the core disk.

FIGS. 45 and 46 are views showing a seventeenth embodiment of the invention.

Figure 41:
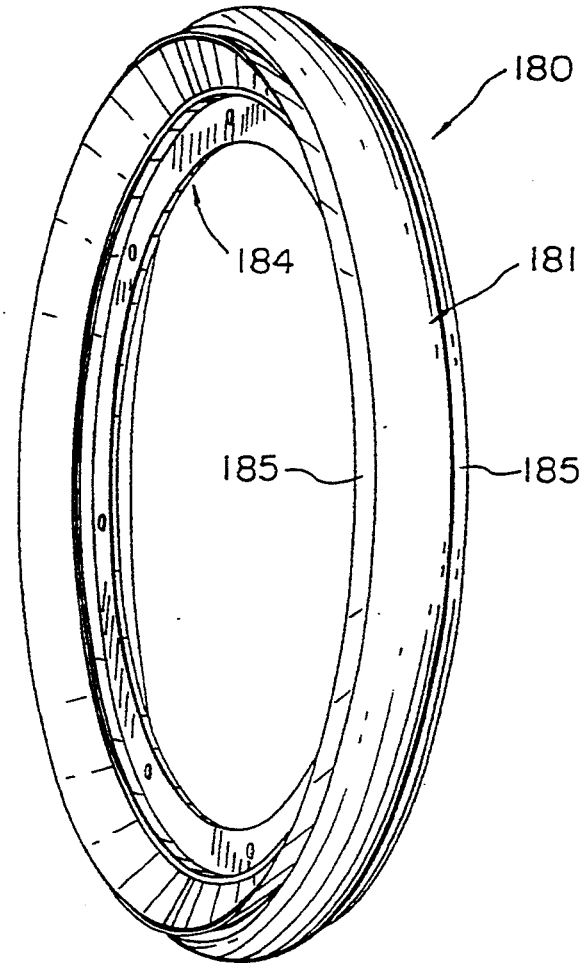
FIG. 41 is a perspective view showing the external appearance of a sixteenth embodiment of the invention.
Figure 42:
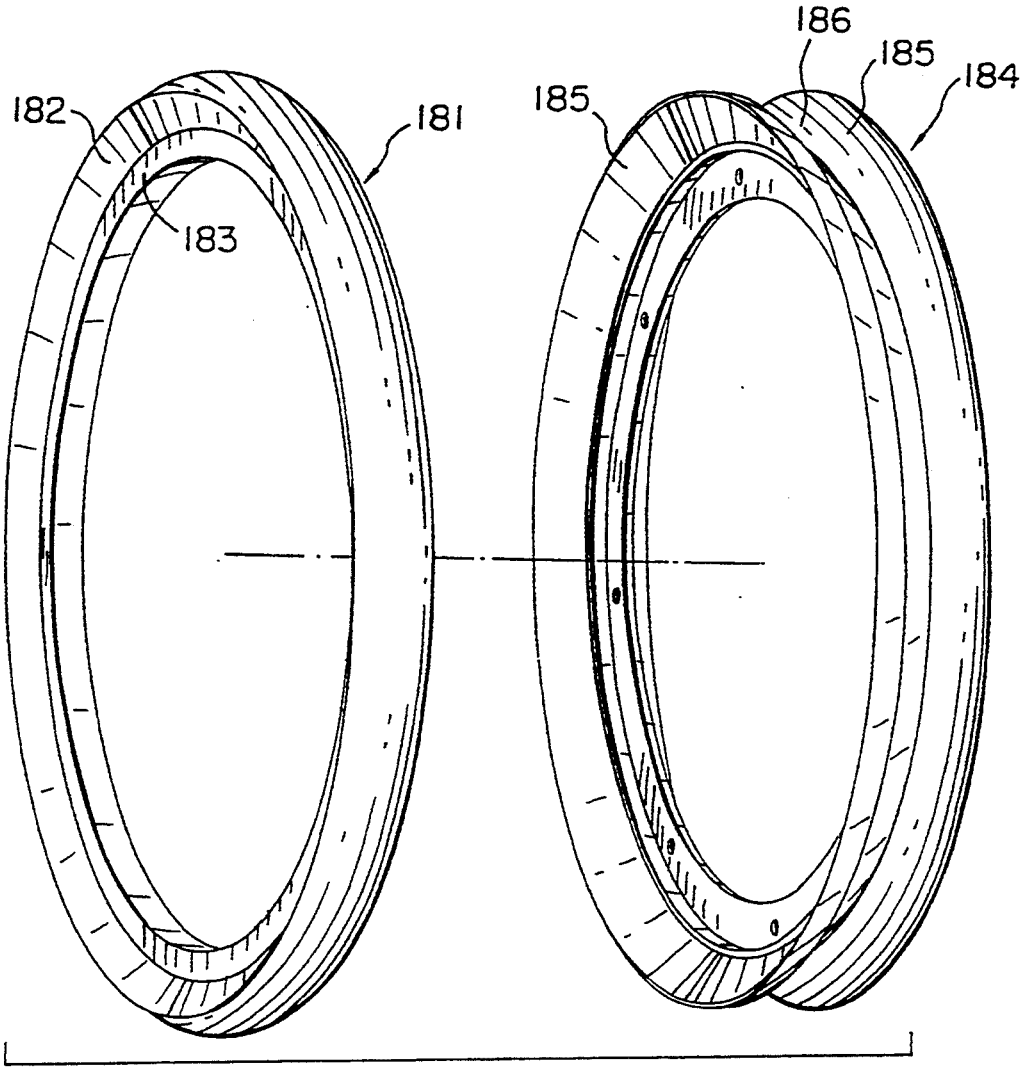
FIG. 42 is an exploded perspective view of the same.

Referring to the drawings, reference numeral 191 designates an elastic tire in the form of a ring without any slits, similarly as in the preceding embodiment in FIG. 41, and this elastic tire 191 has a section in which the dimension of width of the lateral portion 192 of the outer periphery is larger than that of the base end portion 193. Further, the top surface 192*a* of the lateral portion 192 is planar to facilitate the elastic deformation.

A core disk 194 which has a construction similar to that shown in FIG. 23 is embedded in the interior of the elastic tire 191. The base end portion 193 of the elastic tire 191 is held between two circular rims 196 together with the base end portion 195 of the core disk 194, and the circular rims 196 are connected through a disk-like connection 197 to a hub 198 for a wheel axle.

The elastic wheel 190 according to the present embodiment, in the interior of which the core disk 194 is provided, enables the loading capacity, the elastically restoring force and the like to be elevated largely as compared with the preceding sixteenth embodiment. Besides, superior effects such as the improvement of wear resisting property due to the provision of the core disk in the elastic tire as described above can be similarly obtained.

Figure 47:
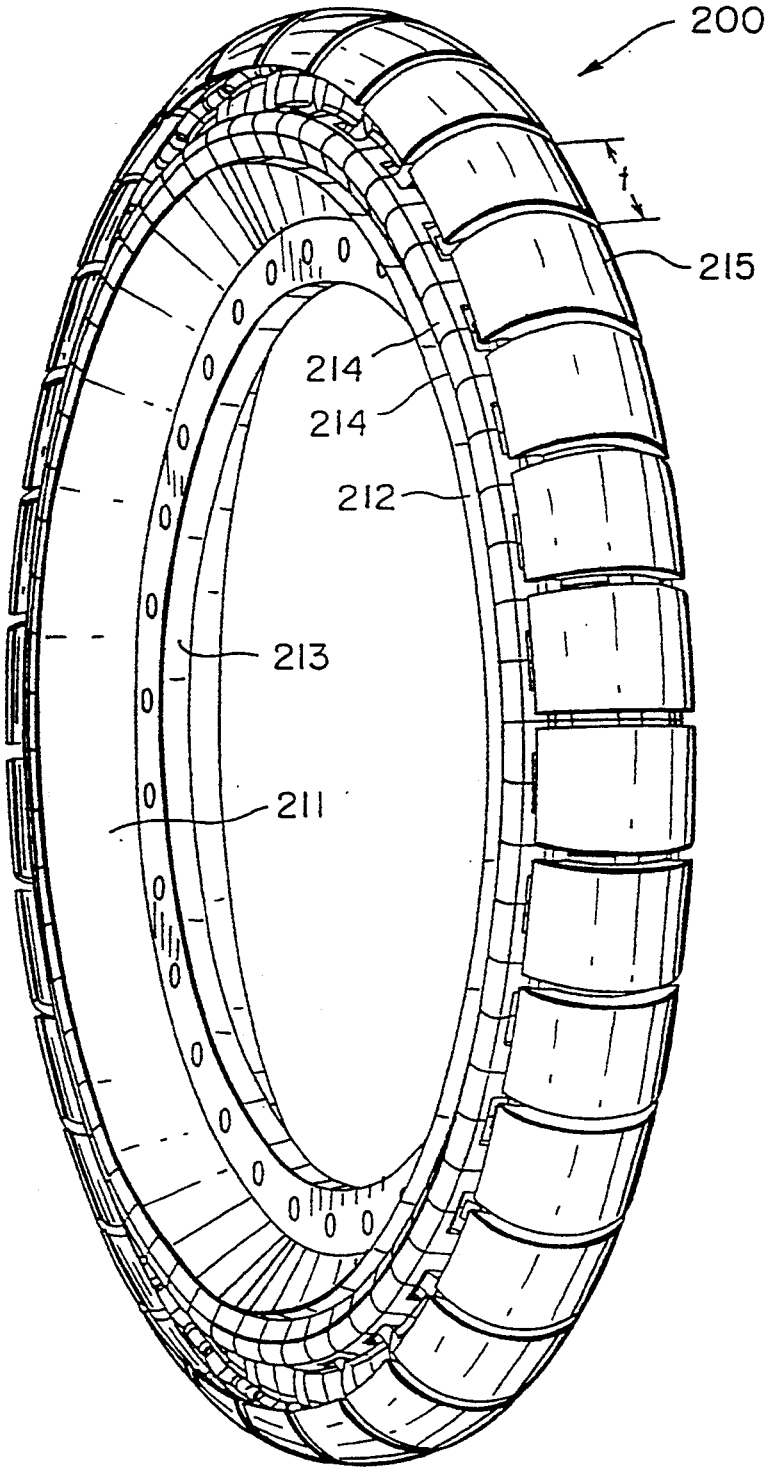
FIG. 47 is a perspective view showing the external appearance of an eighteenth embodiment of the invention.

FIG. 47 is a perspective view showing the exterior appearance of an eighteenth embodiment of the invention. Referring to the drawing, reference 211 designates a disk for supporting an entire wheel, which is formed on the outer periphery thereof with a circular rim part 212 and provided in the middle portion thereof with openings 213 through which a wheel axle (not shown) is inserted.

Figure 48:
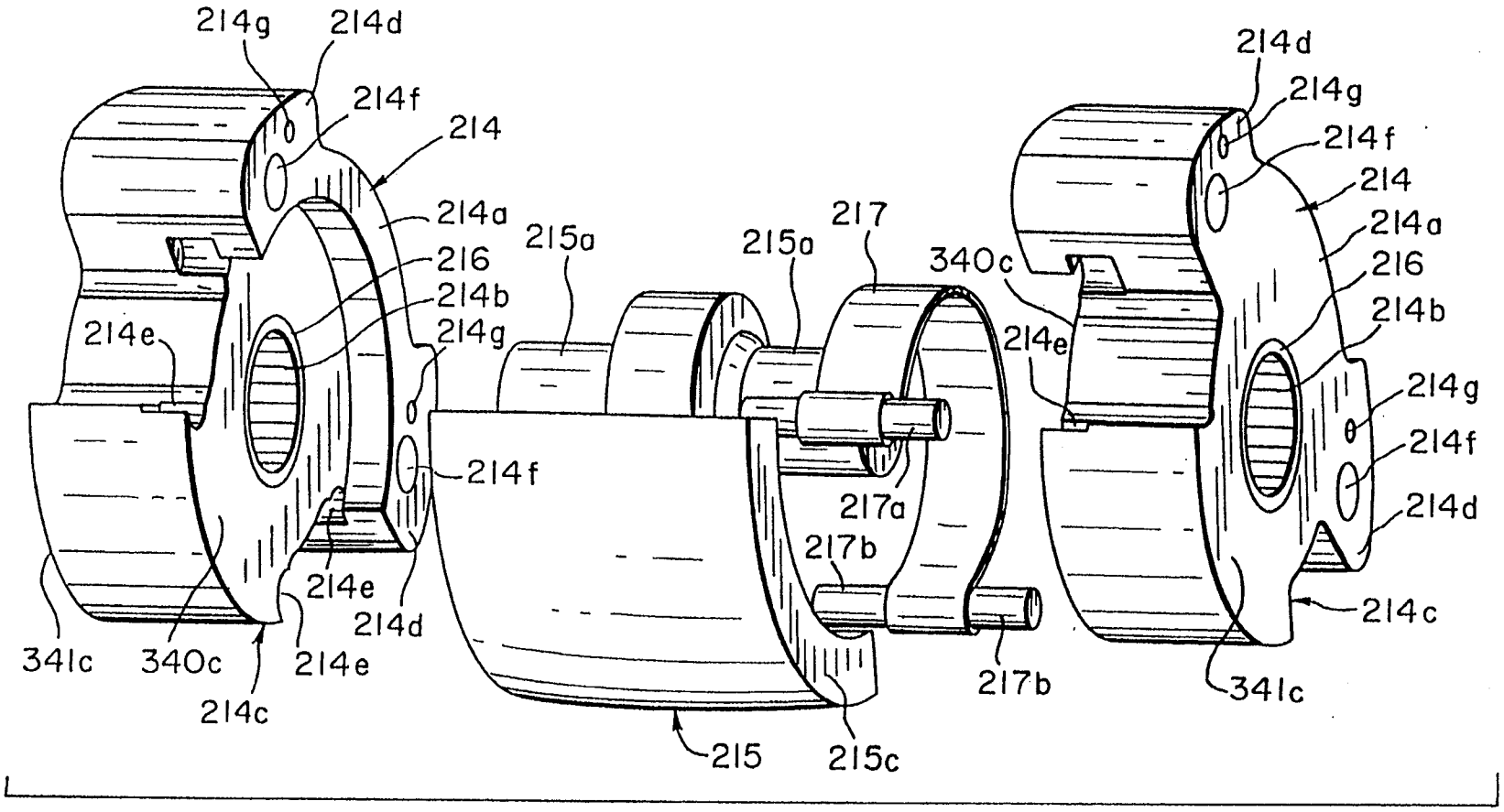
FIG. 48 is an exploded perspective view showing the assembled construction of bearing members and a swinging member.

The circular rim part 212 is formed on the outer periphery thereof with a concave groove (not shown), in which bearing members 214 as shown in FIG. 48 are fitted and arranged on the circumference at equal pitch intervals.

Each of the bearing members 214 comprises a projection 214*a* fitted in the concave groove, a bearing portion 214*c* formed with a bearing hole 214*b* and a pair of jaws 214*d* adapted to be brought into an abutting engagement with the circular rim part 212 so as to hold the outer periphery of the circular rim part 212 therebetween from both sides of the circular rim part. One, 340*c*, of the side surfaces of the bearing portion 214*c* is formed with a stepped portion in a position retracted axially from the projection 214*a* and the jaws 214*d*, and the other opposite side surface 341 is formed so as to be flush with the projection 214*a* and the jaws 214*d*.

A pair of half circular grooves 214*e*, with which a spring supporting shaft as described later is adapted to be brought into an abutting engagement, are formed at positions of symmetry in said one side surface 340*c* near the bearing portion 214*c* of the bearing member 214. The jaw portions 214*d* are each provided with a threaded hole 214*f* for fixing the bearing member and a positioning hole 214*g*.

Figure 49:
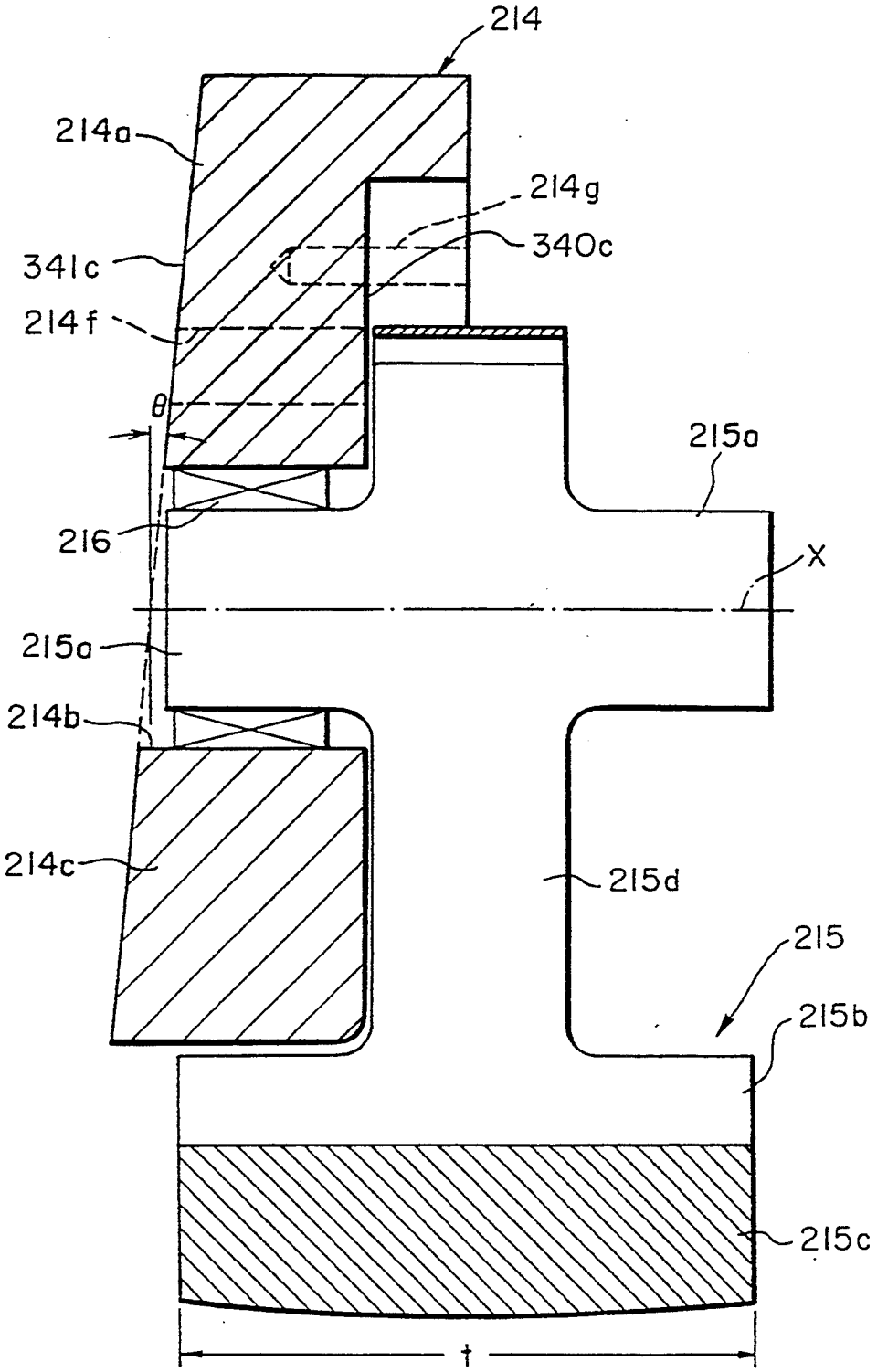
FIG. 49 is a schematic sectional view showing the assembled construction of the bearing members and the swinging member.

As shown in FIG. 49, the other side surface 341*c* of the bearing member 214 is inclined by $\theta$ with respect to the line intersecting perpendicularly to the axis x of the bearing hole 214*b*, and the projections 214*a* are made smaller in the dimension of circumferential thickness than the bearing portion 214*c*. The angle $\theta$ is determined by the number of the bearing members arranged on the circumference of the circular rim 212; the larger the number, the smaller is the angle $\theta$.

One side surface 340*c* of the bearing member 214 is perpendicular to the axis x of the bearing hole 214*b*.

The two bearing members 214, which are assembled facing each other from respective side surfaces, are so arranged on the outer periphery of the circular rim part 212 that the axis x of the bearing holes 214*b* are directed in the same direction as that tangential to the circular rim part 212. The bearing members 214 are assembled on the circular rim part 212 by inserting fixing screws (not shown) in the screw holes 214*f* and fitting locating pins (not shown) in the aligning holes 214*g*.

A swinging member 215 having swinging trunnions or shafts 215*a* is provided for swinging about the swinging shafts 215*a* between the pair of bearing members 214 and 214 assembled as described above. As shown in FIGS. 48 and 49, the swinging member 215 comprises a pair of swinging shafts 215*a* extending to the left and right, an arc-like flange extending in one direction perpendicular to the swinging shafts 215*a*, an arc-like rim 215*b* formed at the outer end of the flange 215*d* and having a width "t" in the direction of the swinging shafts 215*a* and an elastic portion 215*c*, for example, a rubber portion secured to the rim 215*b* so as to cover the outer periphery thereof. Preferably, the width "t" of the rim 215*b* is as great as possible on the condition that the adjacent rims 215*b* do not interfere with each other.

The swinging shafts 215*a* are rotatably supported in the bearing holes 214*b* through bearings (for example, plane bearings or antifriction bearings) disposed in the bearing holes 214*b*. The elastic portion 215*c* of the swinging member is disposed so as to extend in the radially outward direction from the bearing members.

A leaf spring 217, which is elastically displaced according to the swing of the swinging member 215 but serves to restore the swinging member 215 from a swung position to an original position, is disposed between the pair of bearing members 214. The leaf spring 217 is bent in the form of an arc and has at both ends thereof spring supporting shafts 217*a*, 217*b* secured thereto. The leaf spring 217 is provided between the pair of bearing members 214 so as to enclose the swinging shafts 215*a* by bringing the spring supporting shafts 217*a*, 217*b* into an abutting engagement with half-circular grooves 214*a* formed in the respective one of the side surfaces of the bearings 214*c* (Refer to FIG. 50).

The swinging members 215 assembled in this way are arranged on the outer periphery of the circular rim part 212 to constitute the tire part of the elastic wheel 200 (Refer to FIG. 47).

Figure 50:
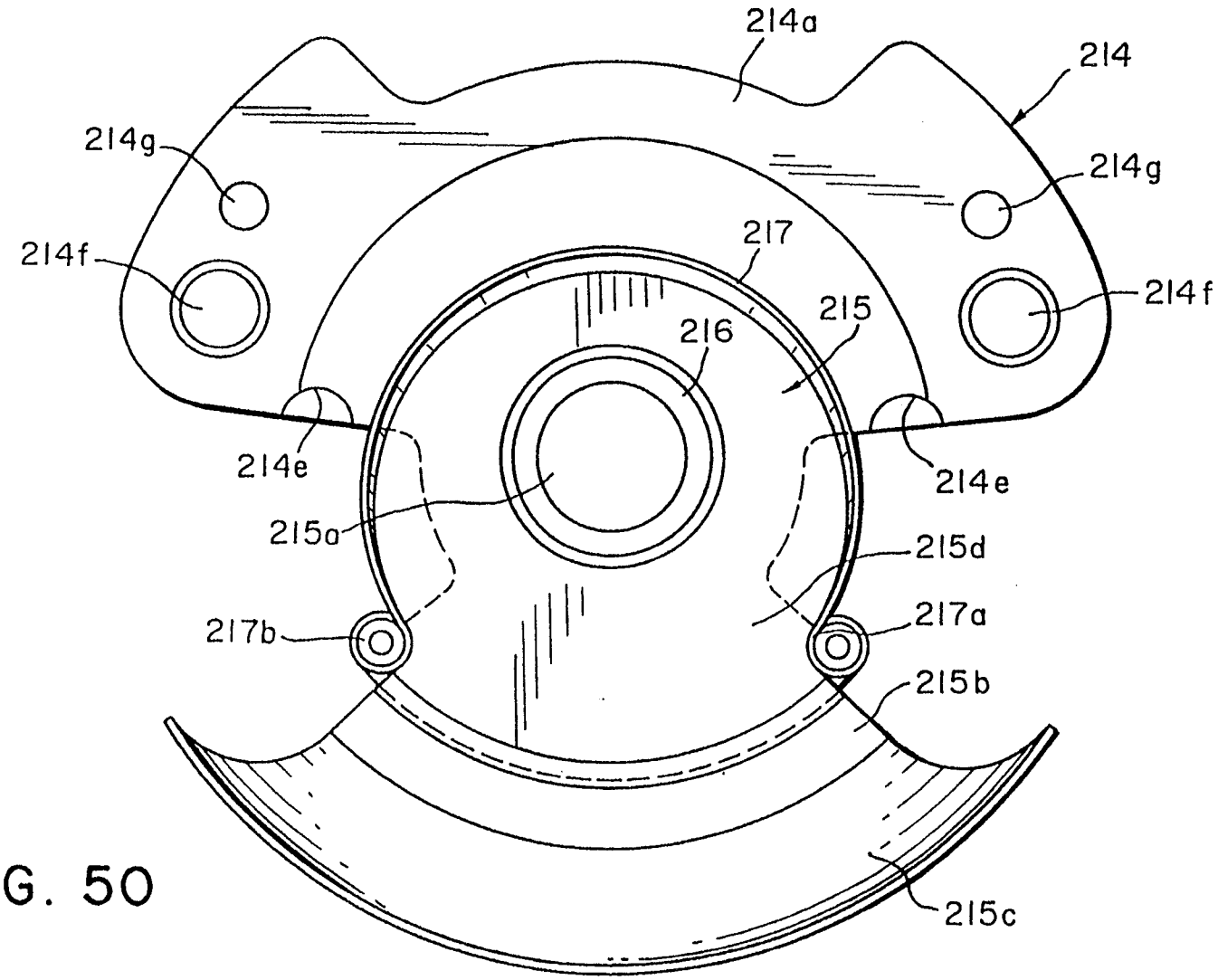
FIG. 50 is a side view showing the state wherein the swinging member is in the original position.

Now, the operation of the present embodiment constituted as described above will be described. FIG. 50 illustrates the state where a force in the direction perpendicular to the direction of the running rotation is not applied to the elastic wheel 200. In this case, the elastic wheel 200 performs a rolling movement while engaging the elastic portions 215*c* of the elastic members 215 with the ground, similarly as in the ordinary wheel.

Figure 51:
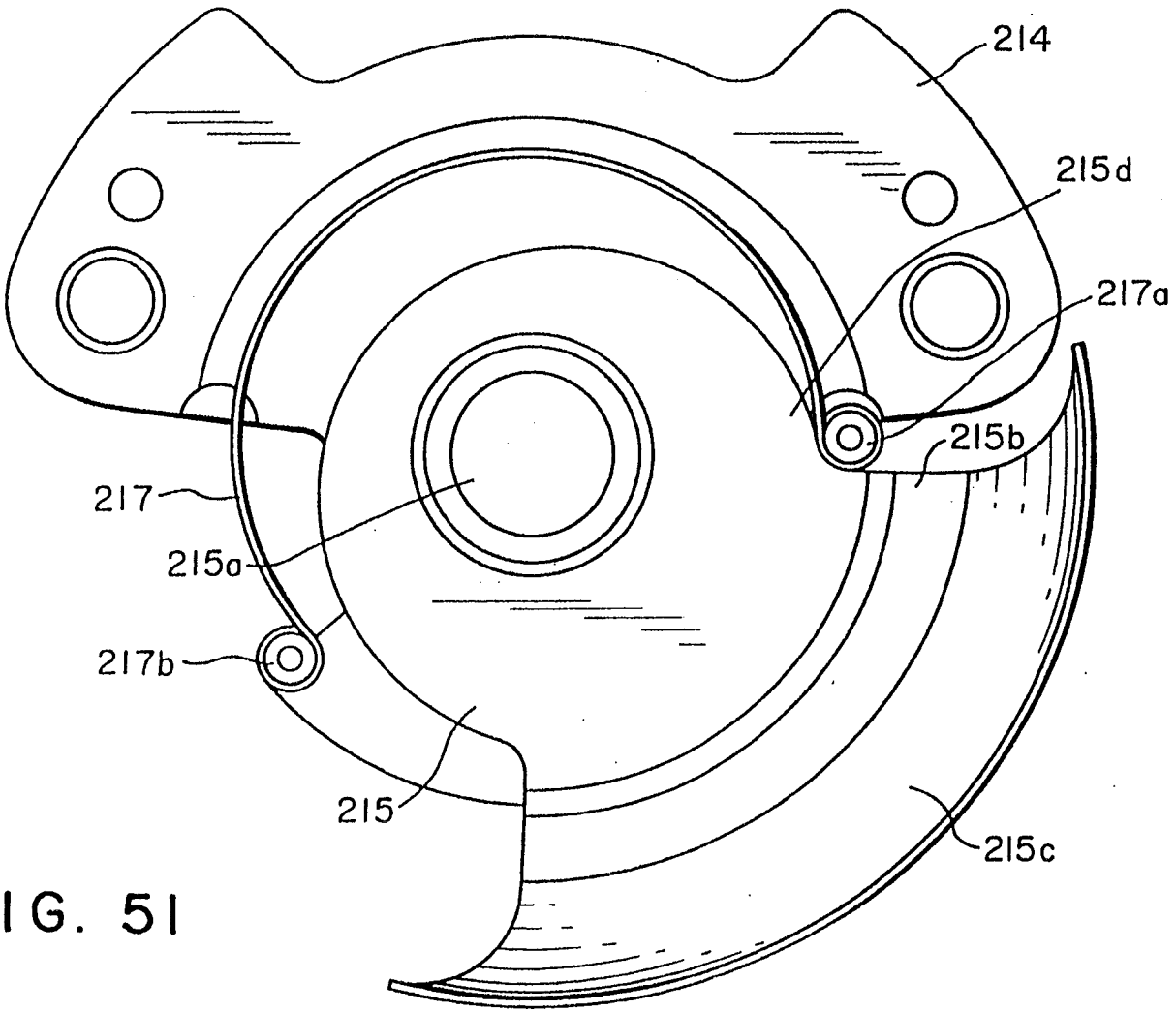
FIG. 51 is a side view showing the state wherein the swinging member is swung.

In the case where a force in the direction perpendicular to that of the running rotation of the elastic wheel 200 is applied thereto, the swinging member 215 in contact with the ground is swung about the swinging shafts 215*a* in the direction opposite that of the acting force, as shown in FIG. 51. In this case, one of the spring supporting shafts 217*a* is brought into an abutting engagement with the flange 215*d* of the swinging member 215 and is moved in swinging motion in the same direction. This causes the leaf spring 217 to be elastically deformed so that a force is applied to the swinging member 215 to restore it to the original position shown in FIG. 50.

The rotation of the elastic wheel 200 causes the swinging member 215 swung in this way to be substituted in order by the following one, and the swinging member 215 which has left the ground surface is restored to its original position by the biasing force of the leaf spring 217, while the swinging member 215 which has come to the position where it comes into contact with the ground is subjected to a transverse force to thereby be swung. This produces the action where the elastic wheel 200 advances while causing a shift (sideslip) in the direction (opposite the direction of swing) perpendicular to the direction of the running rotation.

Figure 52:
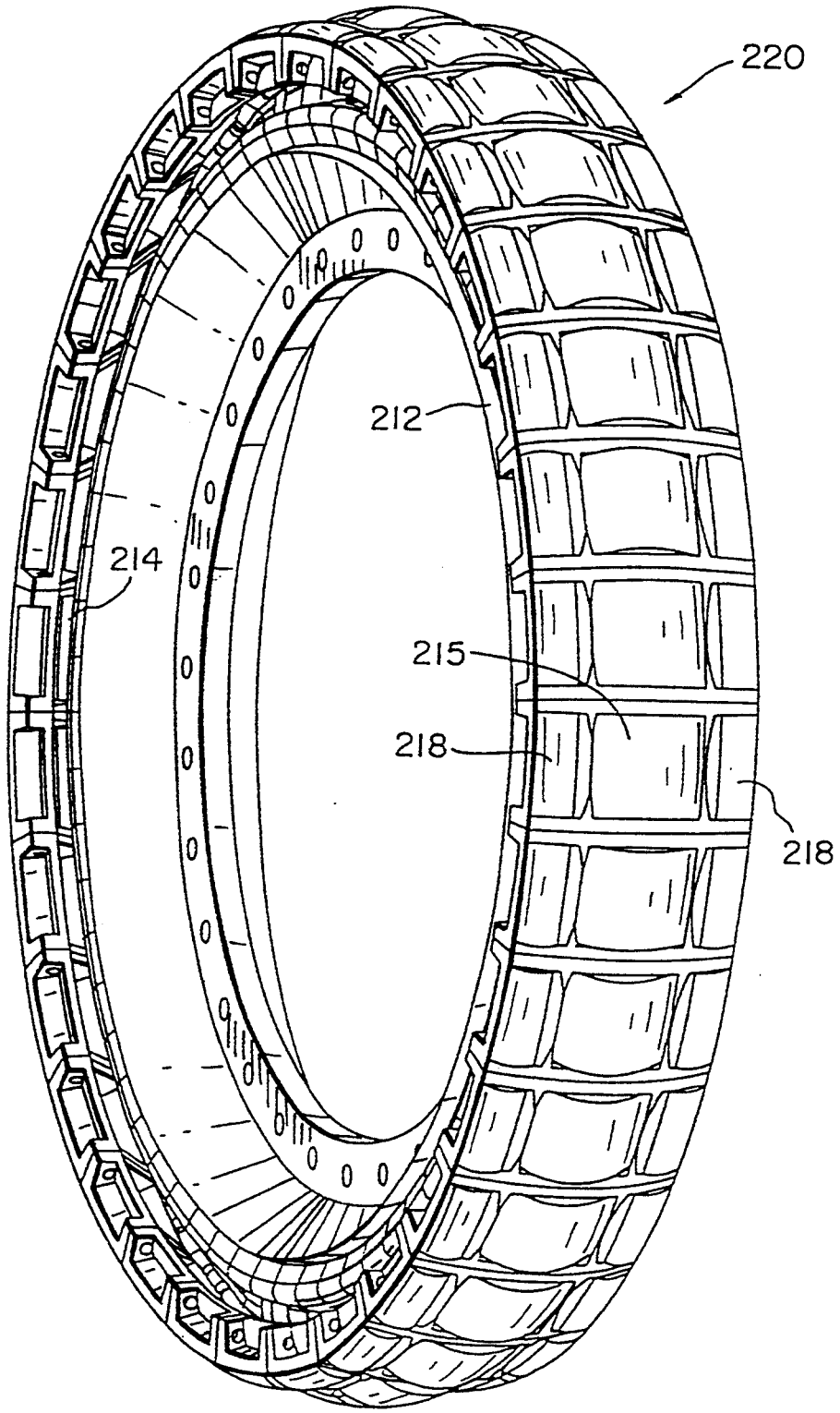
FIG. 52 is a perspective view showing the external appearance showing a nineteenth embodiment of the invention.
Figure 53:
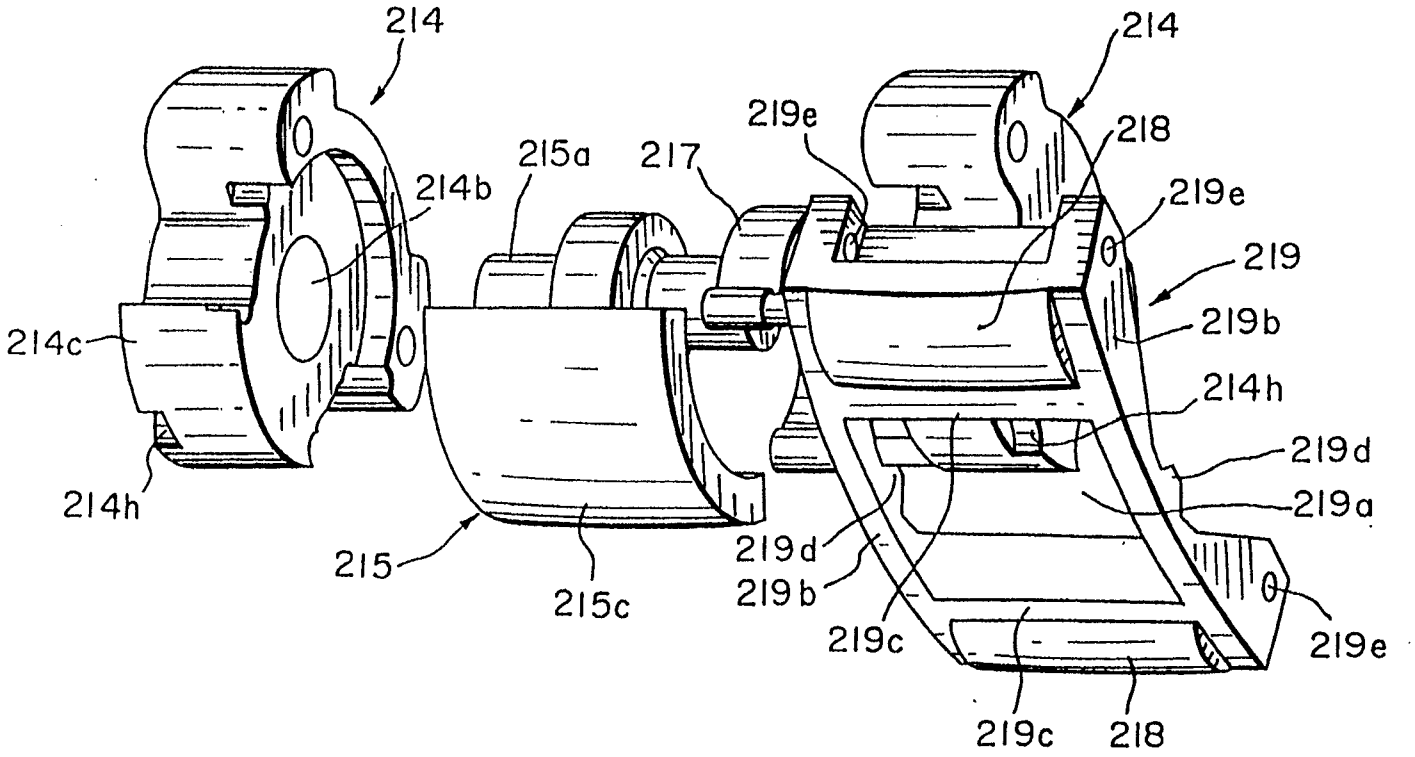
FIG. 53 is an exploded perspective view showing the assembled construction of the bearing members and the swinging member in the nineteenth embodiment.
Figure 54:
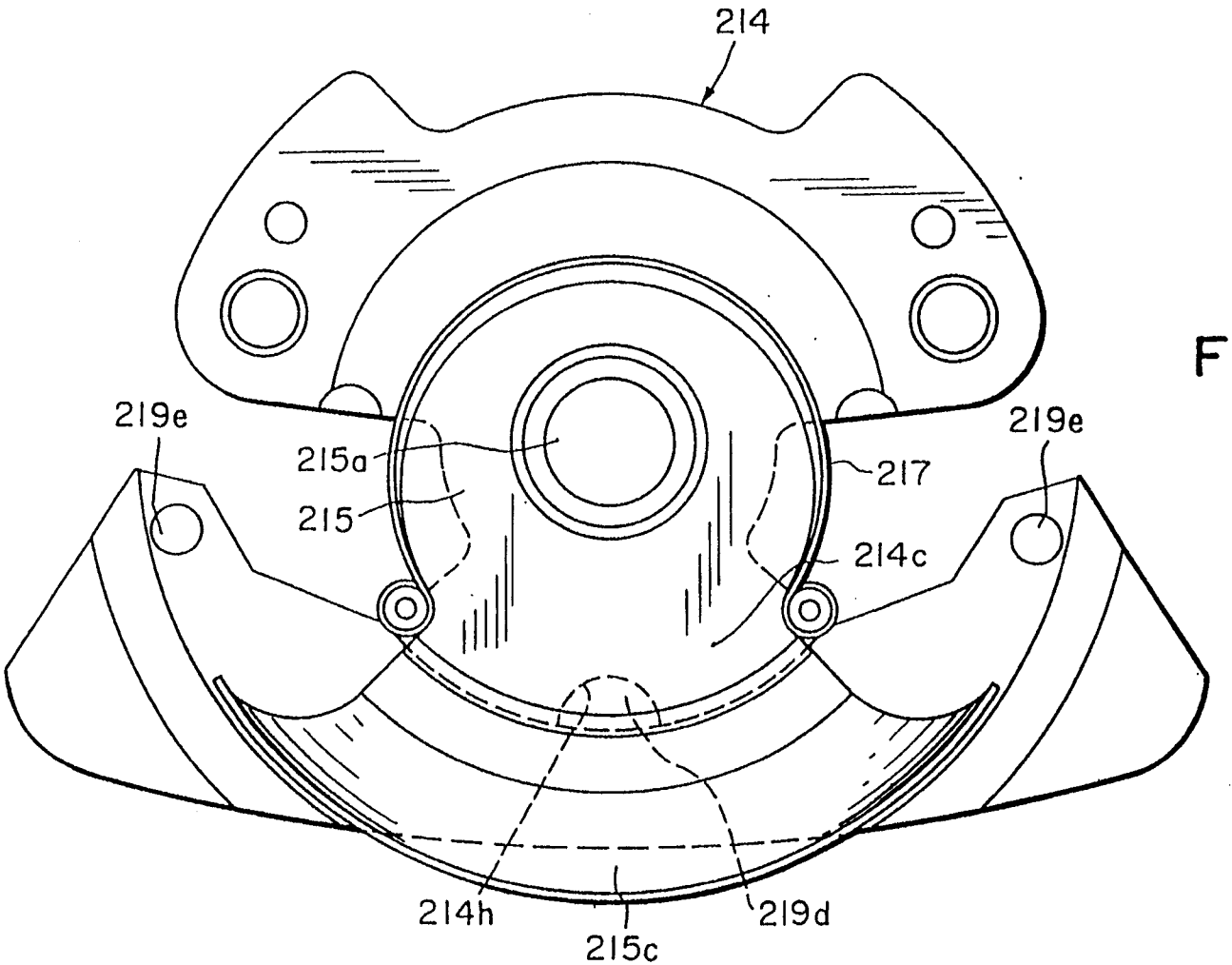
FIG. 54 is a view corresponding to FIG. 50 in the nineteenth embodiment.

FIGS. 52 to 54 are views showing a nineteenth embodiment of the invention. In this embodiment, edge members 218 are attached in positions on opposite lateral sides of the swinging member 215 in the preceding embodiment as described above. The same references are affixed to the same components as those in the preceding embodiment, and descriptions thereof are omitted.

As shown in FIG. 53, the edge members 218 are attached to opposite ends of a substantially rectangular frame 219 having openings 219*a* at the center which allow the elastic portion 215*c* of the swinging member 215 to pass therethrough. The frame 219 is constituted by a pair of side plates 219*b* parallel to each other and a pair of connecting plates 219*c* perpendicular to the side plates 219*b* and defining the opening together with the side plates 219*b*.

The edge members 218 are located in positions at opposite outer ends of the frame 219, which is enclosed by the connecting plates 219*c* and the pair of side plates 219*b*, so that they extend over the outer end of the frame 219. A resilient material, for example a rubber material, is used as the edge members 218.

The pair of side plates 219*b* are provided at the center thereof with half circular projections 219*d* extending in the radially inward direction of the elastic wheel 220, the half circular projections being fitted in half circular recesses 214*h* formed in the bearing portions 214*c* of the bearing members 214, and the radially inner faces of the pair of side plates 219*b* being configured so that each of them comes into contact with the outer periphery of the bearing portion in the form of a circular arc.

Further, the pair of side plates 219*b* are provided at opposite ends thereof with wire holes 219*e* in which a wire is inserted therethrough. Similarly, in the embodiment as described above, the swinging members 215, with the swinging shafts 215*a* supported at both ends thereof by the pair of bearing members 214, are incorporated between the pair of bearing members 214 together with the leaf spring 217 and arranged on the outer periphery of the circular rim part 212 at equal pitch intervals. Then, the frame 219, to which the edge members 218 are secured, is attached by fitting the projections 219*d* of the side plates 219*b* into the recesses 214*h* of the bearing members 214 so that the elastic portion 215*c* of each of the swinging members 215 slightly projects through the opening 219*a*. The frames 219 are connected with each other by wires (not shown) inserted in the wire holes 219*e* and secured to the outer periphery of the circular rim part 212.

The elastic wheel 220 assembled in this way is of such construction that the edge members 218 are located at opposite sides of each of the swinging members 215, and the dimension of width of the tire part is larger than that of the embodiment as described above by the dimension of the edge members 218.

Also, in the elastic wheel 220 according to the present embodiment, application of a force in the direction perpendicular to that of the running rotation of the elastic wheel causes the swinging member 215 to be swung so that the elastic wheel 220 is shifted in the direction inclined by some angle with respect to the direction of the running rotation. The arrangement of the edge members 218 at both sides of the swinging member 215 in the present embodiment also enables the edge members 218 to support a load when the elastic wheel 220 is tilted, thereby enhancing the loading capacity of the elastic wheel 220. Moreover, in the case where an operator performs a sideslip on a slope, he can carry out the action of applying a load and a brake using the edge members 218, and therefore can change the running direction of the elastic wheel 220 at an acute angle without using any special steering device.

FIGS. 55 to 61 are views showing a twentieth embodiment of the invention. In the present embodiment, rubber members attached to both sides of swinging members are used as elastically restoring means to restore the swinging members from a swinging position to an original position.

Figure 55:
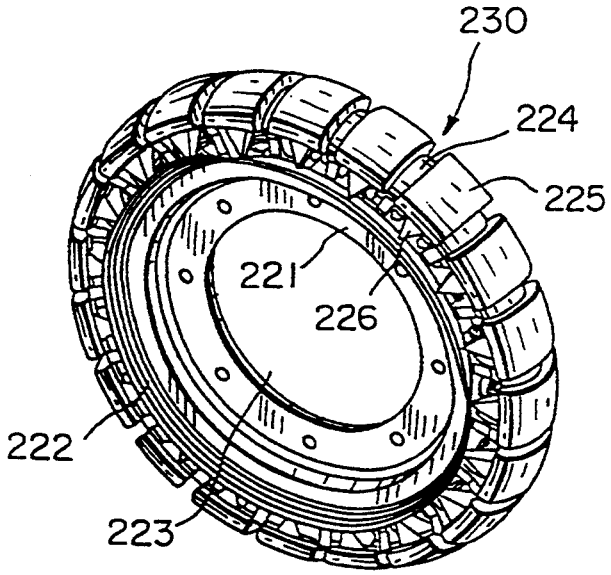
FIG. 55 is a perspective view showing the external appearance of a twentieth embodiment of the invention.

FIG. 55 is a perspective view showing the exterior appearance of an elastic wheel 230 according to the present embodiment. Referring to the drawing, reference 221 designates a disk for supporting the entire wheel, which is formed on the outer periphery thereof with a circular rim part 222 and provided at the center thereof with an opening 223 in which a wheel shaft (not shown) is inserted.

Figure 56:
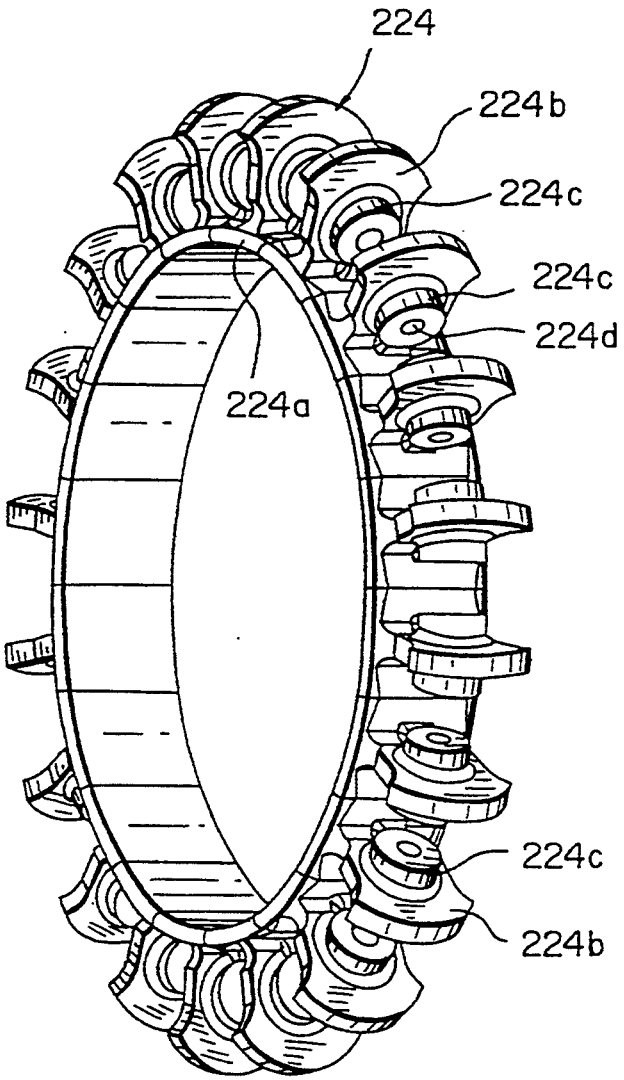
FIG. 56 is a perspective view showing the external appearance of an arrangement of the bearing members in the twentieth embodiment.

The circular rim part 222 has concave grooves 222*a* (refer to FIG. 60) on the outer periphery thereof, in which the base end portions 224*a* of bearing members 224 shown in FIG. 56 are arranged at equal pitch intervals. Each of the bearing members 224 comprises a plate-like supporting portion 224*b*, bearing portions 224*c* extending from both side surfaces of the plate-like supporting portion 224*b* and a base end portion 224*a* substantially perpendicular to the plate-like supporting portion 224*b*. Each of the bearing portions 224*c* is provided with a bearing hole 224*d* having an axis inclined from a line perpendicular to the plate-like supporting portion 224*b* toward the base end portion 224*a* by an angle $\theta$ (refer to FIG. 59). The base end portion 224*a* is bent in the form of an arc so as to extend along the outer periphery of the circular rim part 222.

Figure 57:
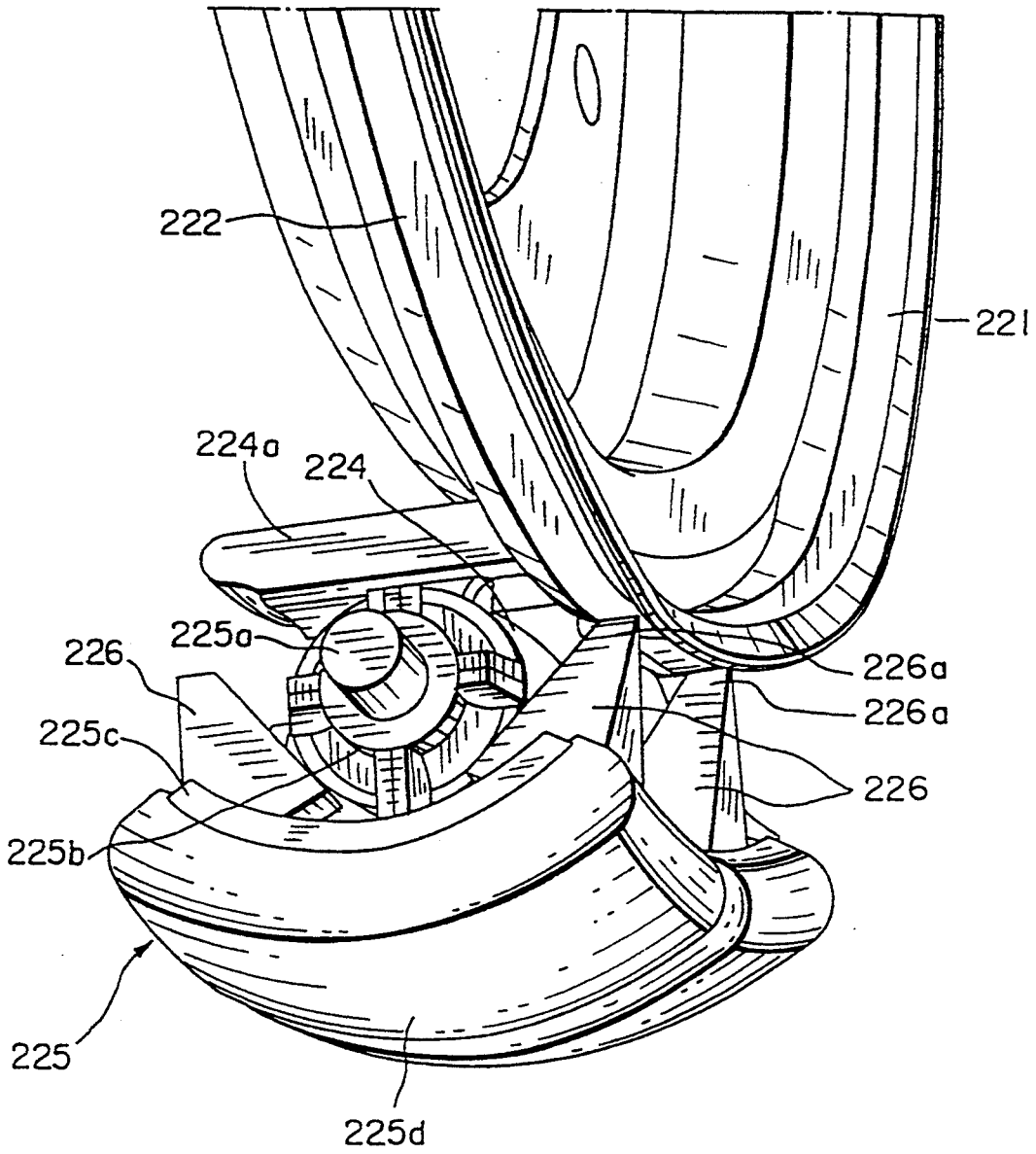
FIG. 57 is a fragmentary perspective view showing on an enlarged scale the construction of the mounted swinging member.
Figure 58:
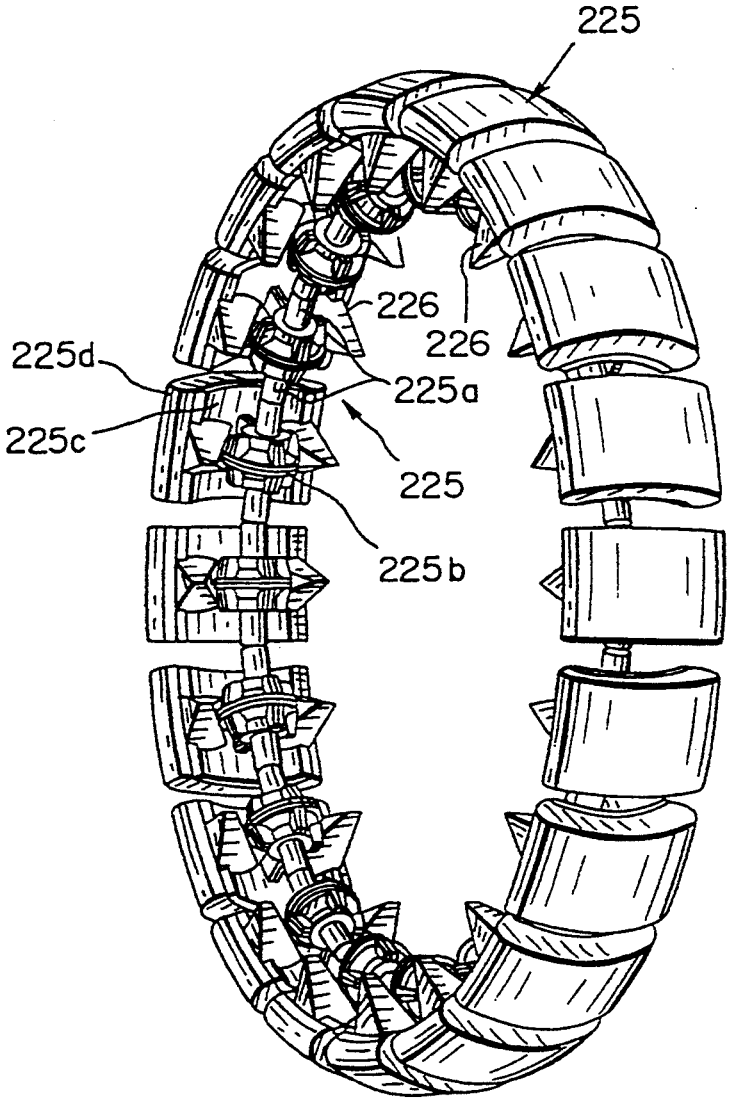
FIG. 58 is a perspective view showing the external appearance of an arrangement of the swinging members in the twentieth embodiment.
Figure 59:
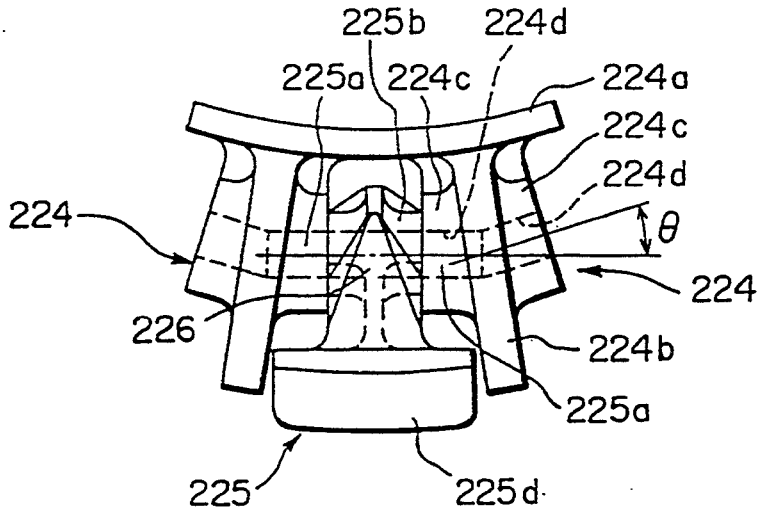
FIG. 59 is a fragmentary side view showing on an enlarged scale the assembled construction of the swinging member and the bearing members.

FIGS. 57 and 58 illustrate swinging members 225 supported for swinging by the bearing members 224. Each of the swinging members comprises a boss 225*b* having swinging trunnions or shafts 225*a* at opposite ends thereof, an arc-like rim 225c secured to the outer peripheral end of the boss 225b and an elastic portion (for example, rubber portion) 225d attached to the rim 225c so as to cover it. The swinging member 225 of the present embodiment further has a pair of rubber members 226 fixedly disposed between the boss 225b and the rim 225c. The rubber members 226 serve to restore the swinging members 225 from a swinging position to an original position, and each has an end 226a extending to the position where it comes in abutting engagement with the inner wall surface of the circular rim 222.

The swinging member 225 is disposed between the pair of bearing members 224 and held with the swinging shafts 225a rotatably inserted in the bearing holes 224d of the bearing members 224. In this way, a tire part of the elastic wheel 230 is formed by arranging the swinging members 225 on the outer periphery of the circular rim 222 at equal pitch intervals.

Figure 60:
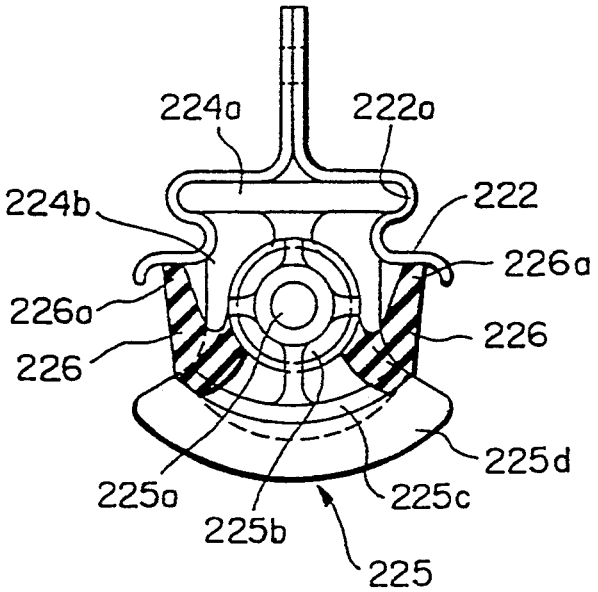
FIG. 60 is an explanatory view showing the state wherein the swinging member is in an original position.
Figure 61:
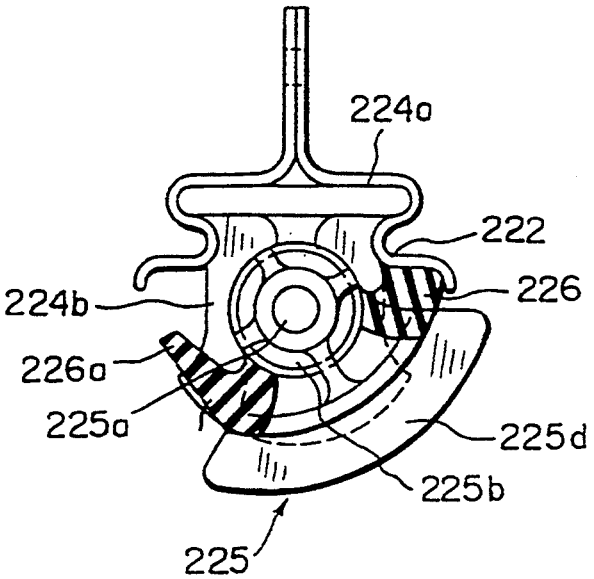
FIG. 61 is an explanatory view showing the state wherein the swinging member is swung.

In the elastic wheel 230 according to the present embodiment, when a force is not applied in the direction perpendicular to that of the running rotation, the swinging members 225 are in the position shown in FIG. 60 and the elastic wheel performs an ordinary running rotation. When a force is applied to the wheel in the direction perpendicular to that of the running rotation, the swinging member 225 is swung to the position shown in FIG. 61. That is, the swinging member 225 is swung about the swinging shafts 225a, one of the rubber members 226 being pressed against the inner wall surface of the circular rim part 222 until it is in an elastically compressed state and the end 226a of the other of the rubber members 226 leaving the inner wall surface of the circular rim part 222.

The swing of the swinging members 225 causes the elastic wheel 230 to advance in the direction inclined by some angle with respect to that of the running rotation. The swinging member 225 which has left the ground surface is restored to the original position shown in FIG. 60 by the elastically restoring force of the rubber member 226.

In the present embodiment, since the rubber member secured to the swinging member is used as the elastic member for restoring the swinging member to its original position, the structure of the swinging member is simple to assemble.

Figure 62:
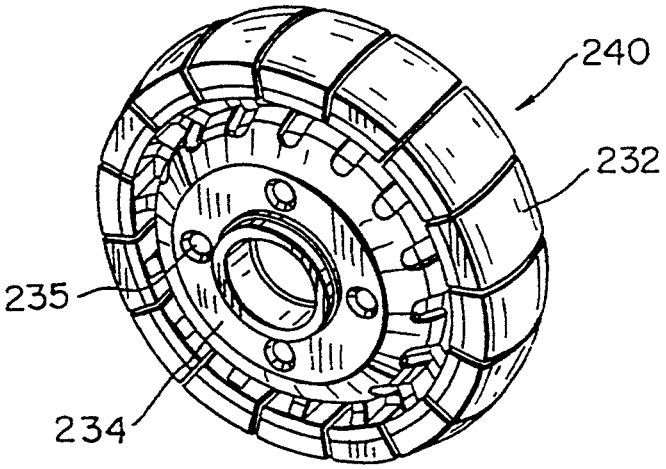
FIG. 62 is a perspective view showing the external appearance of a twenty-first embodiment of the invention.
Figure 63:
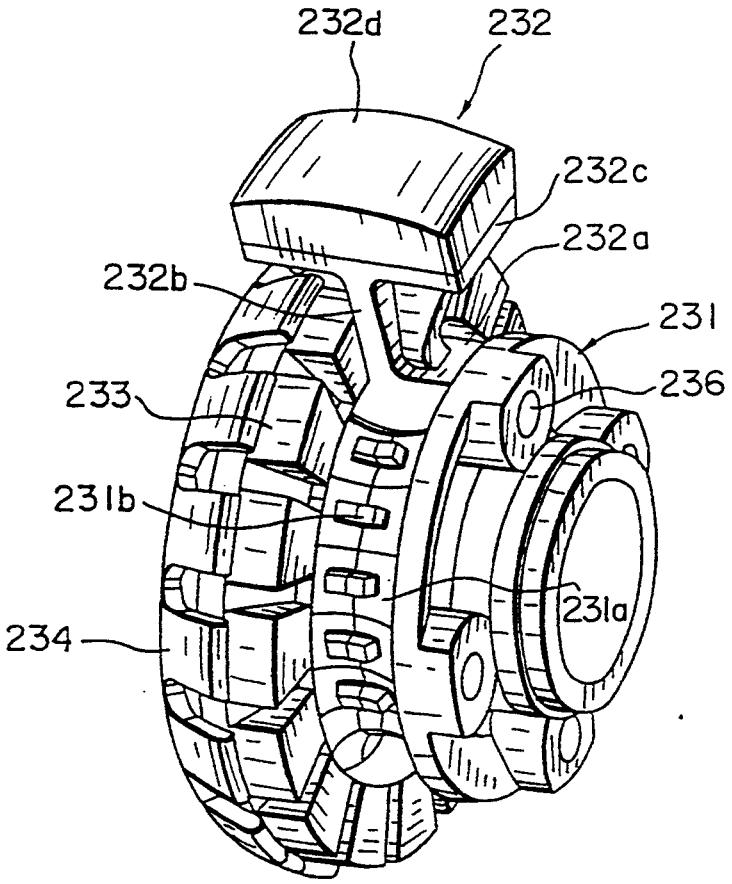
FIG. 63 is a partially disassembled perspective view showing the construction of the twenty-first embodiment.
Figure 64:
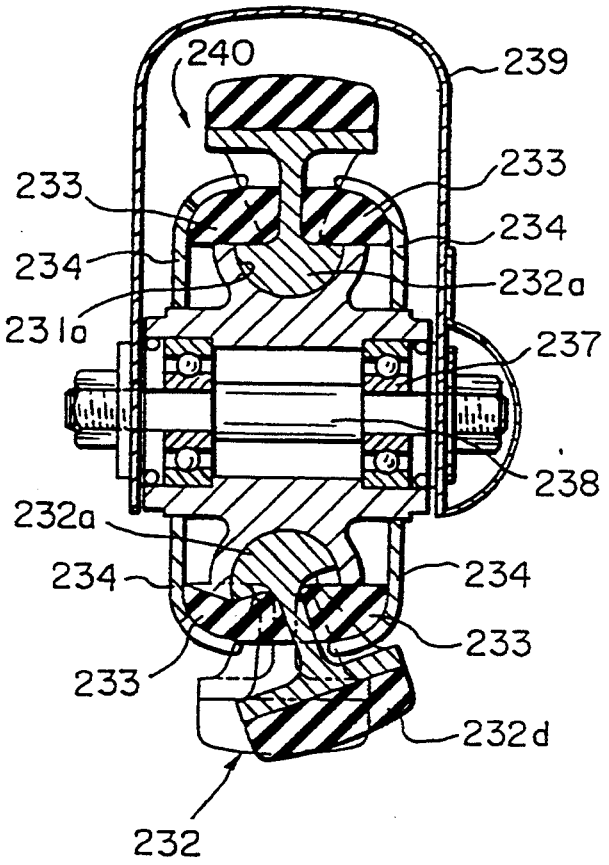
FIG. 64 is a sectional view of the assembled wheel device according to the twenty-first embodiment.

FIGS. 62 to 64 are views showing a twenty-first embodiment of the invention. In the present embodiment, the swinging shaft of a swinging member is of a half-circular section, and rubber members which are in contact with the swinging shaft of a half circular section are used as members to restore the swinging member to its original position.

Referring to FIG. 63, reference 231 designates a disk for supporting the load of the entire wheel. The disk 231 has a concave groove 231a of a half-circular section on the outer periphery. The concave groove 231a is provided therein with projections 231b extending radially to position the swinging member in the circumferential direction at equal pitch intervals.

Reference 232 indicates a swinging member which comprises a swinging shaft of a half-circular section, a plate-like support 232b perpendicular to the swinging shaft 232a and extending in the radially outward direction, a rim 232c perpendicular to the support 232b and an elastic portion 232d attached to the rim 232c to cover it.

The swinging shaft 232a is formed on the outer periphery thereof with a guide groove (not shown) extending circumferentially. The swinging members 232 are arranged in the concave groove 231a of the disk 231 in the circumferential direction at equal pitch intervals by fitting the projections 231b in the guide grooves 231b and bringing the outer periphery of the swinging shafts 232a into contact with the inner wall surface of the concave grooves 231a.

A pair of rubber members 233 are disposed on the upper planar surface of each of the swinging shafts 232a in contact therewith, and the rubber members 233 are fixedly held by covers 234 attached to opposite side surfaces of the disk 231 and having their top ends curved inwardly. (Refer to FIG. 64) Referring to FIG. 62, reference 235 designates screws for fixing the covers 234 to the disk 231, which are threadably engaged with the threaded holes 236 (Refer to FIG. 63) provided on the side surface of the disk 231.

In this way, a tire part of the elastic wheel 240 is constituted by assembling and arranging the swinging members 232 and the rubber members 235 on the outer periphery of the disk 231 (Refer to FIG. 62). FIG. 64 is a sectional view of the elastic wheel 240 according to the invention assembled as described above, which further shows an axle or wheel shaft 238 rotatably supported by bearings 237 and a safety cover 239 for the elastic wheel 240.

In the present embodiment, swinging of the swinging member 232 by an external force causes one of the planar portions of the swinging shaft 232a to press the rubber member 233 and elastically deform it, as shown in FIG. 64. When the swinging member 232 has left the ground, the swinging shaft 232a is rotated by the elastic force of the rubber member 233 and restored to its original position.

The swinging shafts 232a of half-circular sections of the swinging members 232 in the present embodiment do not require the bearing holes for support of the swinging shafts as in the embodiment as described above, and accordingly, the working and assembly of the elastic wheel is easy. In addition, since the present embodiment dispenses with the bearing members between the two adjacent swinging members 232, it is possible to arrange them closely together. This permits the tire part to be constituted by a smooth circular curve.

Figure 65:
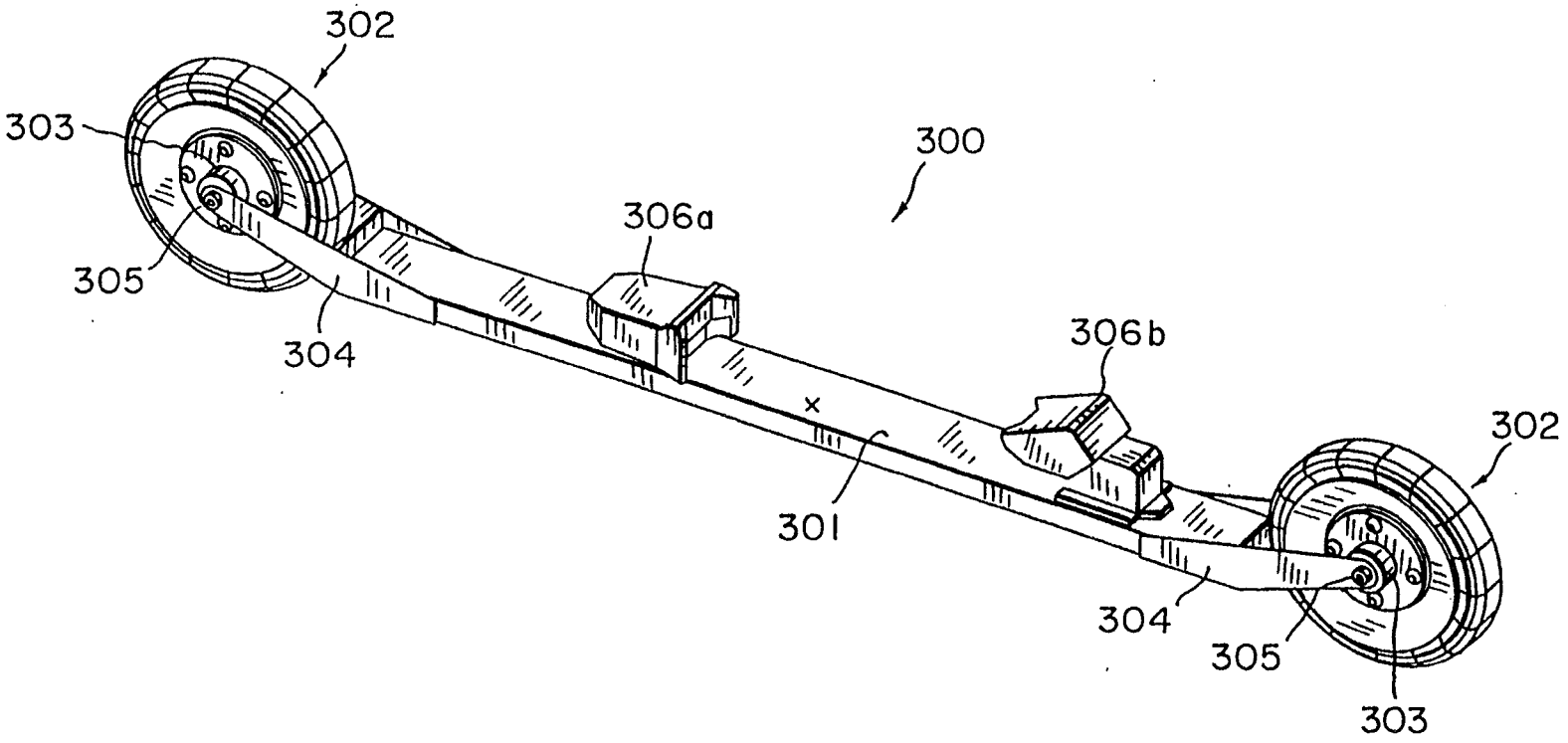
FIG. 65 is a perspective view showing the external appearance of an embodiment of one of a pair of roller skis according to the invention.

FIG. 65 shows an example of one of a pair of roller skis which was constituted by using the elastic wheel according to the invention. This roller ski 300 comprises a flat plate 301 for placing a boot thereon and rotating wheels rotatably attached to the front and rear ends of the boot-placing plate 301. In the present embodiment, any one of the elastic wheels 302 shown in the embodiments as described above are used.

Each of the elastic wheels 302 is supported at the bearing portions 303 thereof by wheel supporting means which comprise a pair of supporting frames 304 fixedly secured to the boot-placing plate 301 at the base end portions and an axle or wheel shaft 305 mounted on the other ends of the supporting frames 304.

Devices for fixing the boot, for example metal fittings 306a, 306b for a ski boot, are installed on the boot-placing plate 301. Preferably, the metal fittings 306a, 306b are located toward the rear (the rear wheel side), similarly as in the ordinary skis.

Now, the operation of the present embodiment will be described with reference to FIGS. 66 and 67 for the case where skiing is done using the pair of roller skis constituted as described above.

The operation of skis using the pair of roller skis 300 of the present embodiment is effectively carried out fundamentally by utilizing the action of the elastic wheel described with reference to FIG. 4, but in fact, considerably complicated motions are added thereto, similarly to the motion of ordinary common skis. Accordingly, the turning motion according to the most fundamental "Pflugbogen" will be described here.

Figure 66A:
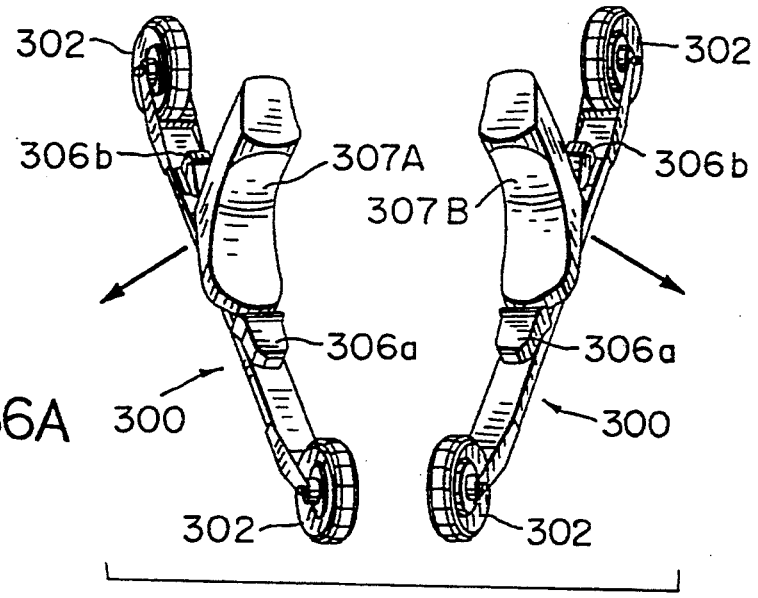
FIGS. 66(A), (B) and (C) are perspective views showing the operations of the pair of roller skis.
Figure 67A:
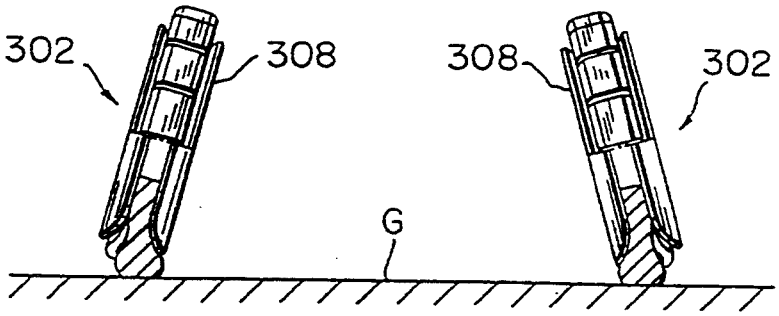
FIGS. 67(A), (B), (C) and (C') are front views, with the lower half sectioned, showing the operations of the elastic wheels of the pair of roller skis.
Figure 68:
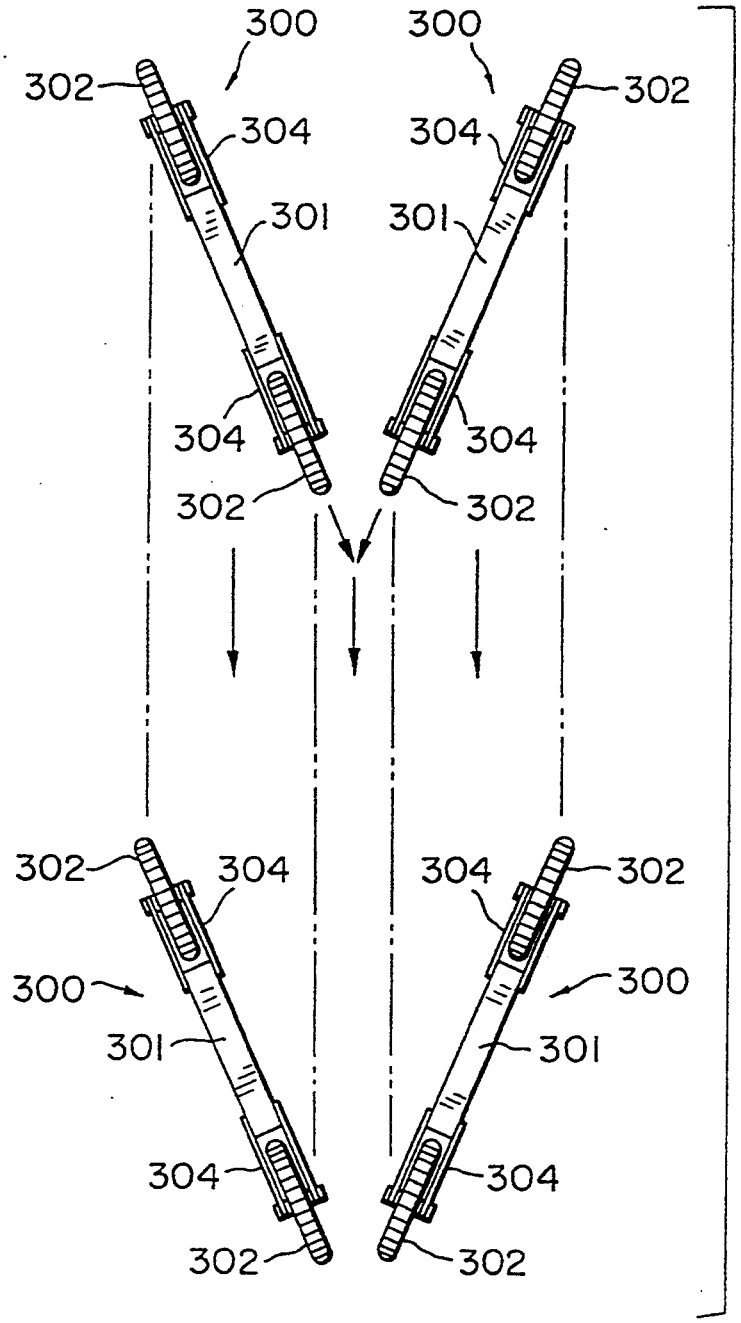
FIG. 68 is an explanatory top view showing the state wherein a skier moves straight in a "Pflug" position using the pair of roller skis according to the invention.

FIG. 66(A) illustrates the state where a skier keeps his roller skis in the form of an inverted-V and runs straight toward a fall line in a "Pflug" position. FIG. 67(A) illustrates the state of deformation of the elastic wheels 302. In this state, respective loads are equally applied to the left and right boots 307A and 307B of the skier and, as shown in FIG. 68, the skis 300 run in the direction of the resultant force of the respective advancing forces (the direction of the fall line).

Figure 66B:
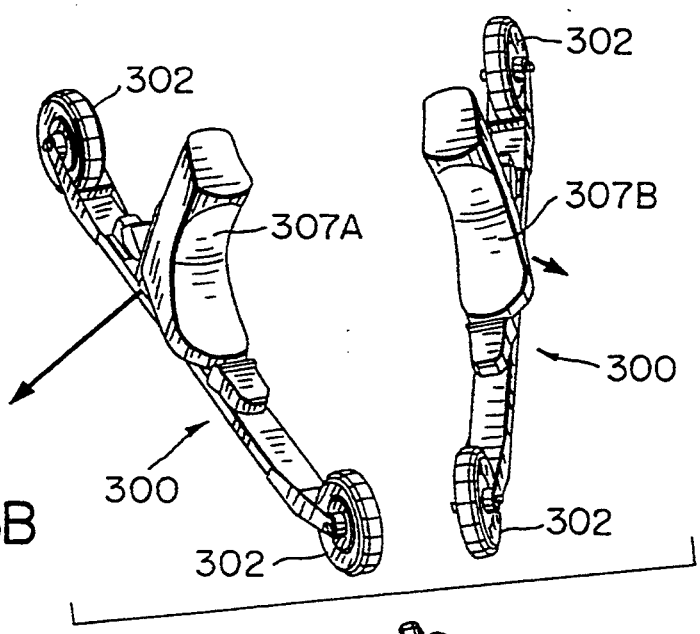
Figure 67B:
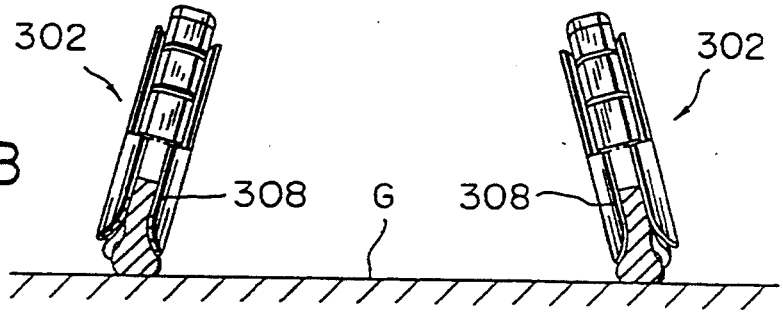

FIG. 66(B) illustrates the state where the skier starts a turn to the left from the "Pflug" position. Further, FIG. 67(B) shows the state of deformation of the elastic wheel 302 at that time. In this state, a load applied to the boot 307B for the left foot is reduced from the straight running state so that the advancing force of the left foot (the force to advance to the right) is reduced. This causes the balance of the forces to the left and right directions to be lost so that a turn to the left is started.

The elastic wheels 302 have the same amount of deformation at the left and right as shown in FIG. 67(B), however the elastic wheel 302 at the right foot (the outside foot) is pressed more strongly against the rim 308 and subjected to a resistance from the ground to produce the action corresponding to the edging of the skis. This provides a force to further advance to the left.

On the other hand, the elastic wheel 302 at the left foot (the inside foot), which is not strongly pressed against the rim 308, is subjected to weak resistance from the ground and therefore also weak force to advance to the right.

Figure 66C:
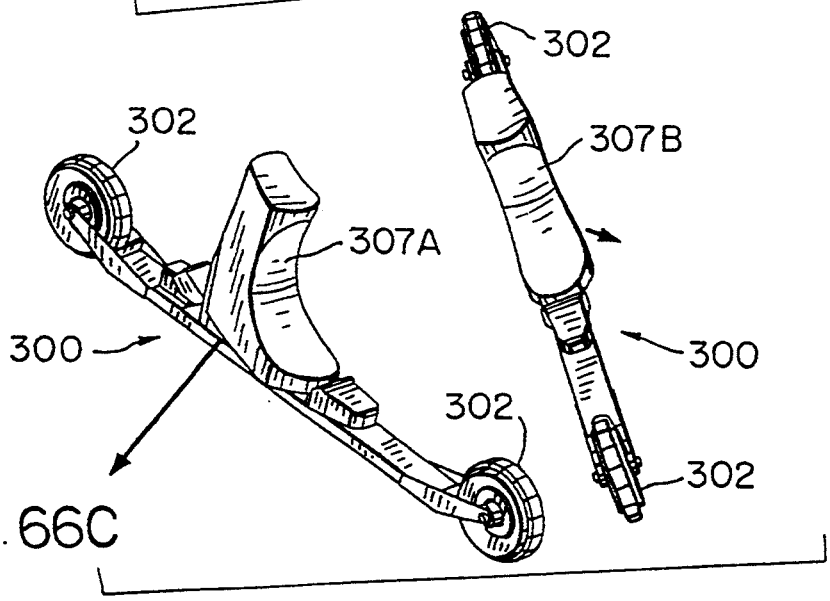
Figure 67C:
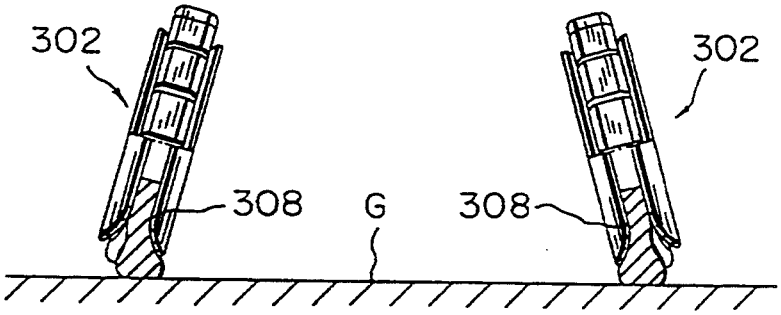
Figure 67C:
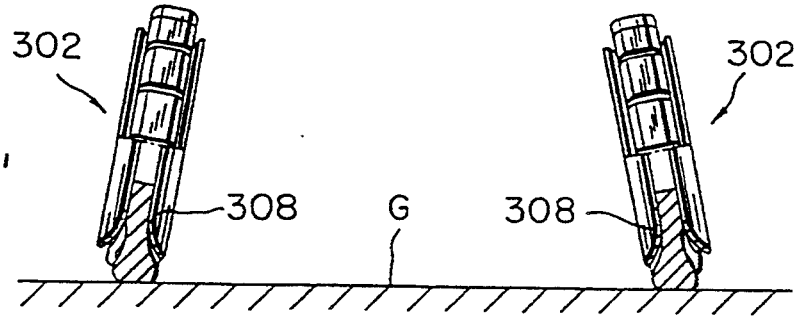

FIG. 66(C) illustrates the state where the skier further continues the turn to the left following the start of the turn. FIGS. 67(C) and 67(C') illustrate the states of deformation of the rear elastic wheel 302 and the front elastic wheel 302.

In these states, the load of the left foot is reduced similarly to the start of the turn, and accordingly, the turn to the left is continued. At this time, the skier does the turn in the form of an arc without running in a straight line to the left and front direction, which is due to the difference between the amounts of elastic deformation (amounts of sideslip) of the front and rear elastic wheels.

Figure 69:
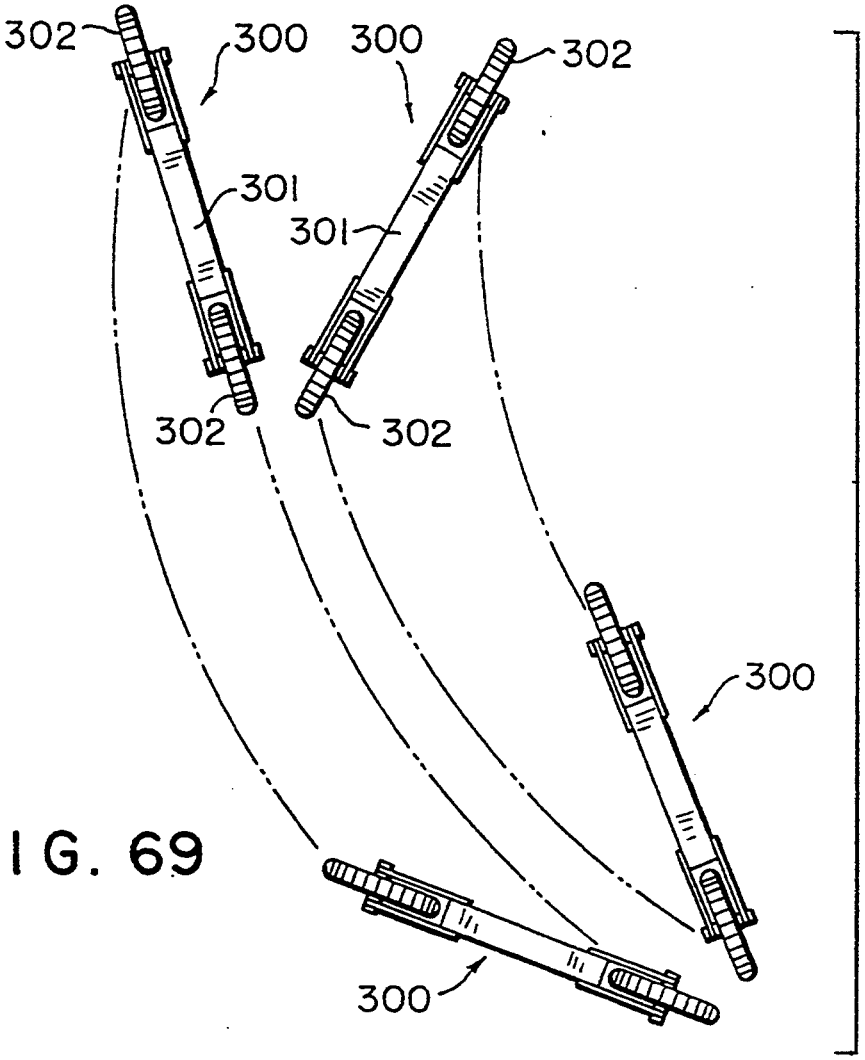
FIG. 69 is an explanatory top view showing the state wherein a skier performs a turn to the left in a "pflug" position using the pair of roller skis according to the invention.

That is, as shown in FIGS. 67(C) and (C'), when the skier does the turn, he applies a force to the ski, pushing out the heel of the outer foot in the direction outside the turn, so that the rear elastic wheel is undergoing greater elastic deformation and therefore greater sideslip than the front elastic wheel. Accordingly, the pair of skis 300 run in the form of a smooth turning arc, as shown in FIG. 69, and the skier can do a "Pflugbogen" with a feeling similar to that of ordinary snow skis.

As described above, the skis 300 according to the invention permit a skier to do a smooth turn by making the amount of transverse shifting of the rear wheel larger than that of the front wheel.

In view of this, the amount of transverse shifting of the front and rear wheels can be changed in the following manner when assembling the skis using the elastic wheels.

(i) The top surface of each of the elastic pieces of the front elastic wheel is formed as a curved surface and the top surface of each of the elastic pieces of the rear elastic wheel is formed as a planar surface.
With this assembly, when the elastic wheels are tilted, the elastic piece of the front elastic wheel shifts in the ground contact point, and accordingly, the amount of elastic deformation thereof becomes smaller than that of the elastic piece of the rear elastic wheel which is difficult to shift in the ground contact area. (Refer to the embodiment shown in FIGS. 20 and 21) This enables the amount of transverse shifting of the front wheel to be made smaller than that of the rear wheel.

(ii) The slits of the elastic pieces of the rear wheel are made larger in depth than those of the front wheel.
With the deepened slits, the amount of elastic deformation of the elastic piece is larger and accordingly, the amount of transverse shifting of the elastic wheel is also larger.

(iii) The clearance between the rim and tire part of the rear wheel is made larger than that of the front wheel.
Since the elastic deformation of the tire part is restricted by the rim, the larger the clearance between the rim and tire is, the larger the amount of elastic deformation thereof is, and accordingly, the amount of transverse shifting of the elastic wheel.

(iv) The elastic modulus of the tire part of the rear wheel is made smaller than that of the front wheel.
This is obtained, for example, by decreasing the hardness of the rubber member constituting the tire part of the rear wheel.
This provides a greater amount of elastic deformation of the rear wheel, which enables the amount of transverse shifting thereof to be made larger than that of the front wheel.

(v) The metal fittings for fixing a boot are provided on the boot-placing plate in position near the rear wheel.
This causes a pushing-out force provided by the heel of a skier to be effectively transmitted to the rear elastic wheel, which facilitates the elastic deformation (transverse shift) of the rear wheel, as compared with the front wheel.

The elastic wheels which have already been described by way of the various embodiments may suitably be selected to constitute a pair of roller skis, so that various kinds of roller skis can be obtained which are suited to skiers from beginners to professionals, sizes of slopes, kinds of games or the like.

Further, the present embodiment shows an example in which the elastic wheels are attached to the boot-placing plate at both the front and rear thereof. However, alternatively, a pair of roller skis having the features of the invention may be provided by attaching any one of the elastic wheels, for example only to the rear of the plate and an ordinary wheel to the front thereof.

Moreover, the present embodiment shows an example in which the elastic wheels are attached to the plate by means of a pair of supporting frames. However, the elastic wheels may be rotatably attached directly to the boot-placing plate by providing longitudinal slots in the boot-placing plate and disposing the elastic wheels in the slots.

Figure 70:
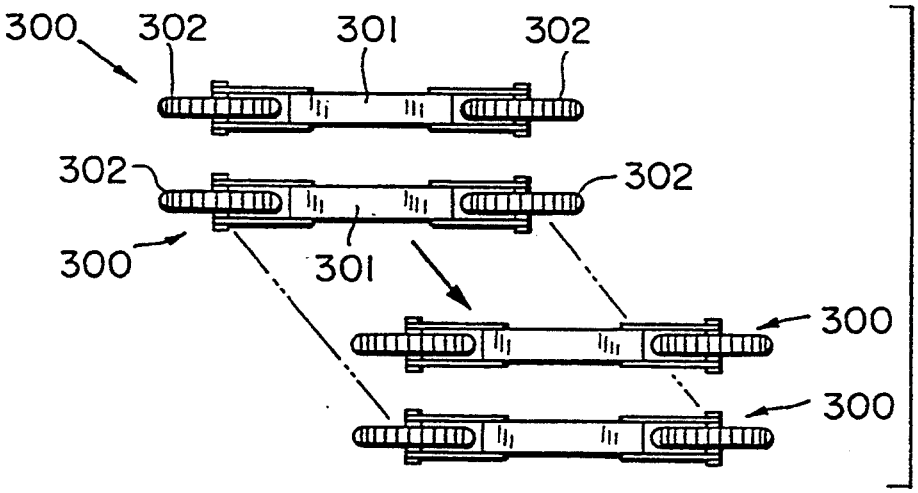
FIG. 70 is an explanatory top view showing the state wherein a skier performs a motion of sliding down obliquely using the pair of roller skis.

FIG. 70 shows the state where a skier is obliquely sliding down a slope using the pair of roller skis according to the invention. That is, the pair of skis 300 are arranged in one direction and a load is applied to the side of the valley (not upslope), so that the elastic wheels 302 are caused to be shifted transversely, thereby permitting the roller skis to produce a sideslipping motion with a feeling similar to generally skiing on snow.

INDUSTRIAL APPLICABILITY

As described above, with the elastic wheel according to the invention, application of an external force to the wheel in the direction perpendicular to the running direction of the wheel causes a required elastic deformation to be continuously produced in the tire part according to the size of the external force, enabling the wheel to be sideslipped, stopped suddenly and turned at an acute angle.

Further, the roller skis according to the invention, which utilizes the features of the elastic wheel as described above, provide motions such as running, turning, stopping and the like with a feeling substantially similar to generally skiing on snow. Accordingly, use of the present invention in "Gelande" or sports facilities during an off-season without snow makes it possible to carry out real skiing matches similar to the general skis on snow.

We claim:

1. An elastic wheel, which comprises:

wheel supporting means having a circular rim part formed around an outer periphery thereof; and a tire part mounted on and around said circular rim part of said wheel supporting means and being elastically deformable in a direction perpendicular to the running direction of the wheel, said tire part including a ring-like elastic member, said tire part having a plurality of transverse radial slits arranged in circumferentially spaced relation around the ring-like elastic member to form a plurality of elastic pieces around the circumference of the tire part, said tire part further including a core disk embedded therein and including a plurality of circumferentially spaced disk pieces arranged radially in said elastic member in correspondence with said elastic pieces so that each disk piece is embedded in a respective elastic piece.

2. An elastic wheel as claimed in claim 1, wherein said tire part is provided with a plurality of further radial slits extending circumferentially in each elastic piece.

3. An elastic wheel as claimed in claim 1, wherein each of the slits has a depth at least 0.7 times a minimum dimension of width of the tire part.

4. An elastic wheel as claimed in claim 1, wherein said tire part further comprises circular edge parts at outer sides of each of the elastic pieces extending in an axial direction of the wheel.

5. An elastic wheel as claimed in claim 1, wherein each elastic piece has side faces with elastic projections in abutting engagement with inner wall surfaces of said circular rim.

6. An elastic wheel as claimed in claim 1, further comprising a cover for covering said elastic pieces, said cover being provided with radial slits with a circumferential spacing equal to that of the radial slits in said elastic member.

7. An elastic wheel as claimed in claim 1, wherein each of the elastic pieces has an outer tread surface which is curved.

8. An elastic wheel as claimed in claim 1, wherein each of the elastic pieces has an outer tread surface which includes a planar surface and curved surfaces, said planar surface being substantially at a center of the outer tread surface and said curved surfaces being adjacent to the radial slits.

9. An elastic wheel as claimed in claim 1, wherein each of the elastic pieces has an outer tread surface which includes planar surfaces and a curved surface, said planar surfaces being substantially at a center of the outer tread surface and at an end thereof adjacent to the radial slit opposite the direction of rotation of the wheel and said curved surface being at an end of the outer tread surface adjacent to the radial slit in the direction of rotation of the wheel.

10. An elastic wheel as claimed in claim 1, wherein each elastic piece is provided, at each end adjacent to peripheral edges thereof, with a cut having a width larger than that of the slits.

11. An elastic wheel as claimed in claim 1, wherein each of the disk pieces has an end which is branched into a plurality of sections.

12. An elastic wheel as claimed in claim 1, comprising a receiving washer attached to each of the disk pieces and extending perpendicularly to said disk pieces.

13. An elastic wheel as claimed in claim 11, wherein said plurality of sections of each disk piece are bent in respectively opposite directions.

14. An elastic wheel as claimed in claim 1, wherein said core disk is constituted by a plurality of said disk pieces which are separate from one another.

15. An elastic wheel as claimed in claim 1, wherein said core disk has outer ends extending to an outer peripheral surface of the tire part.

16. An elastic wheel as claimed in claim 1, wherein a base end portion of said core disk extends inwardly to an inner peripheral surface of the tire part and is connected directly to said circular rim part.

17. An elastic wheel as claimed in claim 1, wherein said ring-like elastic member has a cross-section with a transverse width at an outer periphery thereof which is larger than at an inner periphery thereof.

18. An elastic wheel as claimed in claim 1, wherein said radial slits extend partially through the elastic member to form an inner, continuous, annular, base end portion from which said elastic pieces extend radially outwards.

19. An elastic wheel as claimed in claim 18, wherein said base end portion has a uniform thickness.

20. An elastic wheel as claimed in claim 18, wherein said base end portion has a uniform radial height therearound.

* * * * *